US006814545B2

(12) United States Patent
Hext, III et al.

(10) Patent No.: US 6,814,545 B2
(45) Date of Patent: Nov. 9, 2004

(54) FAN BLADE

(75) Inventors: Richard G. Hext, III, Belvidere, IL (US); Donald R. Pennington, Kingston, IL (US); Richard R. Shelby, South Elgin, IL (US); Ling-Zhong Zeng, Lake in the Hills, IL (US)

(73) Assignee: Revcor, Inc., Carpentersville, IL (US)

( * ) Notice: Subject to any disclaimer, the term of this patent is extended or adjusted under 35 U.S.C. 154(b) by 14 days.

(21) Appl. No.: 10/369,215

(22) Filed: Feb. 19, 2003

(65) Prior Publication Data

US 2003/0223875 A1 Dec. 4, 2003

Related U.S. Application Data

(63) Continuation-in-part of application No. 10/141,623, filed on May 8, 2002, now Pat. No. 6,712,584, which is a continuation-in-part of application No. 09/558,745, filed on Apr. 21, 2000, now Pat. No. 6,447,251.

(51) Int. Cl.[7] ..... B63H 1/26

(52) U.S. Cl. ..... 416/210 R; 416/238; 416/DIG. 2; 416/DIG. 5

(58) Field of Search ..... 416/210 R, 223 R, 416/DIG. 2, DIG. 5, 238, 189

(56) References Cited

U.S. PATENT DOCUMENTS

| | | | |
|---|---|---|---|
| 2,258,459 | A | 10/1941 | Marbach |
| 2,853,140 | A | 9/1958 | Forth, Sr. |
| 2,900,202 | A | 8/1959 | Thompson |
| 2,912,159 | A | 11/1959 | Granger et al. |
| 2,952,402 | A | 9/1960 | Morrison et al. |
| 3,223,313 | A | 12/1965 | Kinsworthy |
| 3,251,540 | A | 5/1966 | Kinsworthy |
| 3,285,502 | A | 11/1966 | Wooden |
| 3,407,882 | A | 10/1968 | Wooden et al. |

(List continued on next page.)

FOREIGN PATENT DOCUMENTS

| | | |
|---|---|---|
| CA | 935413 | 1/1973 |
| CA | 923474 | 3/1973 |
| CA | 973135 | 8/1975 |
| CA | 1050508 | 3/1979 |
| CA | 1067871 | 12/1979 |
| CA | 1071164 | 2/1980 |
| DE | 3707437 | 3/1988 |
| EP | 0259182 | 3/1988 |
| EP | 0408221 | 1/1991 |
| EP | 0761980 | 3/1997 |
| EP | 0857528 | 8/1998 |
| GB | 1572767 | 8/1980 |
| GB | 1577244 | 10/1980 |
| JP | 53-96512 | 8/1978 |

OTHER PUBLICATIONS

Advanced Technologies, Low Noise Fan, Extra Fan newly Developed, A & R News, pp. 86–87, Jan./Feb. 1986.

Smart Housewares Highlights, Appliance Manufacturer, pp. 44–45, Mar. 2000.

*Primary Examiner*—Edward K. Look
*Assistant Examiner*—James M. McAleenan
(74) *Attorney, Agent, or Firm*—Michael Best & Friedrich LLP

(57) ABSTRACT

The present invention employs improved fan blade shapes to improve fan blade performance in one or more manners (i.e., increased fan efficiency, lower fan noise, greater fluid moving capability, and the like). In some embodiments, the fan blade has a front side, a rear side, an inner attachment portion, an outer edge, a curved leading edge and a curved trailing edge. The outer edge can define an arc between a forward position and a rearward position of the fan blade. In some embodiments, the leading edge extends outward and intercepts the arc of the outer edge at the forward position, and the trailing edge extends outward to the rearward position. Various angles, lengths, and other dimensions of the blade can have selected values to produce superior fan performance.

24 Claims, 17 Drawing Sheets

U.S. PATENT DOCUMENTS 3,498,529 A 3/1970 Wooden
3,628,888 A 12/1971 Wooden
3,708,243 A 1/1973 Wooden
3,709,633 A 1/1973 Wooden
3,773,435 A 11/1973 Wooden
3,891,349 A 6/1975 Woollenweber, Jr.
3,937,595 A 2/1976 English et al.
3,963,373 A 6/1976 Macauley
4,008,007 A 2/1977 Shipes
4,028,007 A 6/1977 Cavagnero et al.
4,060,338 A 11/1977 Macauley
4,063,852 A 12/1977 O'Connor
D246,856 S 1/1978 O'Connor
4,142,844 A 3/1979 Brattstrom
4,172,691 A 10/1979 Comstock et al.
4,174,924 A 11/1979 Smithson, Jr.
4,189,281 A 2/1980 Katagiri et al.
4,211,514 A 7/1980 Hawes
4,245,960 A 1/1981 Matthews
4,255,080 A 3/1981 Wilson et al.
D262,734 S 1/1982 Wooden
D262,735 S 1/1982 Wooden
D262,736 S 1/1982 Wooden
4,345,877 A 8/1982 Monroe
4,350,100 A 9/1982 Stephenson
4,358,245 A 11/1982 Gray
4,406,581 A 9/1983 Robb et al.
4,474,534 A 10/1984 Thode
4,511,308 A 4/1985 Russell et al.
4,548,548 A 10/1985 Gray
4,566,852 A 1/1986 Hauser
4,569,631 A 2/1986 Gray
4,569,632 A 2/1986 Gray
4,630,999 A 12/1986 De La Harpe
4,634,341 A 1/1987 Monroe
4,720,244 A 1/1988 Kluppel et al.
4,840,541 A 6/1989 Sakane et al.
4,900,228 A 2/1990 Yapp
4,917,572 A 4/1990 Van Houten
4,946,348 A 8/1990 Yapp
4,971,520 A 11/1990 Van Houten
4,995,787 A 2/1991 O'Connor
5,000,660 A 3/1991 Van Houten et al.
5,064,345 A 11/1991 Kimball
5,151,014 A 9/1992 Greenwald et al.
5,154,579 A 10/1992 Rezek
5,156,524 A 10/1992 Forni
5,156,786 A 10/1992 Monroe
5,213,476 A 5/1993 Monroe
5,221,187 A 6/1993 Lorea et al.
5,297,931 A 3/1994 Yapp et al.
5,326,225 A 7/1994 Gallivan et al.
5,328,330 A 7/1994 Monroe
5,342,167 A 8/1994 Rosseau
5,352,089 A 10/1994 Tokunaga et al.
5,423,660 A 6/1995 Sortor
5,489,186 A 2/1996 Yapp et al.
5,511,939 A 4/1996 Tokunaga et al.
5,520,515 A 5/1996 Bailey et al.
5,577,888 A 11/1996 Capdevila et al.
5,616,004 A 4/1997 Alizadeh
5,655,882 A 8/1997 Morgan et al.
5,707,205 A 1/1998 Otsuka
5,769,607 A 6/1998 Neely et al.
5,979,541 A 11/1999 Saito
6,059,532 A 5/2000 Chen et al.
6,135,831 A * 10/2000 Lanni et al. ..... 440/49
6,241,474 B1 6/2001 Alizadeh et al.
6,287,078 B1 9/2001 Min et al.
6,325,597 B1 * 12/2001 Kim et al. ..... 416/238
6,447,251 B1 9/2002 Zeng

* cited by examiner

FAN BLADE

RELATED APPLICATIONS

This is a continuation-in-part of U.S. patent application Ser. No. 10/141,623 filed on May 8, 2002, which is a continuation-in-part of U.S. patent application Ser. No. 09/558,745 filed on Apr. 21, 2000 now U.S. Pat. No. 6,447,251, the entire disclosures of which are hereby incorporated herein by reference.

FIELD OF THE INVENTION

The present invention relates generally to an apparatus and a method for moving fluids, and more particularly to a fan blade and a method of moving fluids with a fan blade.

BACKGROUND OF THE INVENTION

A typical fan assembly consists of a hub, a multi-wing spider, and two or more blades, although in some assemblies the hub and spider can be an integral unit, or the spider and blades can be an integral unit. In some cases, it is even possible to employ a fan assembly in which the hub, multi-wing spider, and blades are a single integral unit. In those fan assemblies in which fan blades are attached to a spider wing, each spider wing is often attached with a blade through riveting, spot welding, screws, bolts and nuts, other conventional fasteners, and the like.

Fan assemblies are employed in a large number of applications and in a variety of industries. However, there exist a number of common design criteria for fans in many of such applications: fan efficiency, noise, and the like. For example, it is desirable for a fan assembly of a residential or commercial air conditioning system to be as efficient and quiet as possible, resulting in energy savings and a better operating system.

With continued reference to air conditioning system applications by way of example only, the fans in such systems are typically directly driven by a motor to draw airflow through condenser coils to achieve a cooling effect. Existing condenser fan assemblies employ rectangular blade shapes. Although these fans will generate sufficient airflow to meet varied cooling needs when the fan blades are pitched properly, such fans also radiate high levels of noise during operation and can be relatively inefficient.

In many applications, the upstream airflow of a rotating fan is partially blocked by a motor or other driving unit, frame or other structural members, and other elements. For example, in a typical condenser cooling application, the upstream airflow of a rotating fan is often partially distorted due to the blockage of a compressor, controlling panels, etc. As a result, tonal and broadband noise is often generated by the leading edges of the rotating fan blades as they cut through the flow distortion (i.e. turbulence). In addition, each segment of the fan blade leading edge along the radial direction can act as a noise radiator.

In light of the above shortcomings of conventional fans, there are increasing market demands for fans that can generate sufficient air for cooling at reduced noise levels. In addition, fan assemblies and fan blades that are durable, easy to manufacture, easy to assemble, and are inexpensive are highly desirable for obvious reasons.

SUMMARY OF THE INVENTION

The present invention employs improved fan blade shapes to generate improved fan blade performance in one or more manners (i.e., increased fan efficiency, lower fan noise, greater fluid moving capability, and the like). In some embodiments, the fan blade is shaped to reduce noise during operation thereof.

The fan blade of the present invention can be formed from a flat blank bent to a desired shape to form the fan blade. Alternatively, the fan blade can be cast, molded, or produced in any other manner desired.

In some embodiments of the present invention, the fan blade has a front side, a rear side, an inner attachment portion, an outer edge, a curved leading edge and a curved trailing edge. The outer edge can define an arc between a forward position and a rearward position of the fan blade. In some embodiments, the leading edge extends outward and intercepts the arc of the outer edge at the forward position, and the trailing edge extends outward to the rearward position.

The shapes of the blades of the various embodiments of the present invention can be defined at least in part by one or more angles or lengths, including the radius of the fan assembly at different locations on the blade (e.g., the radius of the fan assembly $R_L$ at a leading edge of the fan blade and/or the radius of the fan assembly $R_T$ at a trailing edge thereof), a radius of a circle that coincides or substantially coincides with a majority or all of the length of a trailing edge of the blade, an angle at which a leading edge of the fan blade is swept forward, an angle at which a trailing edge of the fan blade is swept forward, the chamber-to-chord ratio of the leading edge of the fan blade, the chamber-to-chord ratio of the trailing edge of the fan blade, the chamber-to-chord ratio of a cross-section of the blade at various radial distances of the blade (from the rotational axis thereof), and an angle of the outer radial portion of the blade with respect to a plane passing perpendicularly through the rotational axis of the blade. Blades falling within the spirit and scope of the present invention can be at least partially defined by the size of any one or more of these blade parameters.

In some embodiments, the angle at which the leading edge of the fan blade is swept forward is formed by a straight line having a length equal to $R_L$ extending from a given axis coinciding with the axis of the fan to the forward position of the fan blade (mentioned above) and a line extending from the axis to a first position on the leading edge and having a length equal to about $0.5R_L$ wherein the angle $\propto_L$ is equal to at least 35 degrees. In other embodiments, this angle is formed by a straight line extending from the axis to the forward position of the fan blade and a line extending from the axis to a first position on the leading edge and having a length equal to about 0.65R, wherein R is the radius of the fan assembly and $\propto_L$ is between 15 and 45 degrees, 20 to 35 degrees, or 25 to 30 degrees (in different embodiments of the present invention). In other embodiments, this angle is formed by a straight line extending from the axis to the forward position of the fan blade and a line extending from the axis to a first position on the leading edge and having a length equal to about 0.75R, wherein R is the radius of the fan assembly and $\propto_L$ is between 15 and 35 degrees, 18 to 30 degrees, or 20 to 28 degrees (in different embodiments of the present invention).

In another aspect, the chamber-to-chord ratio of the leading edge of the fan blade in some embodiments is larger than about 0.10 but less than about 0.20, wherein $L_L$ is the length of a straight line from the first position to the forward position and $H_L$ is the maximum distance from $L_L$ to the leading edge as measured from a straight line perpendicular to $L_L$ and extending to the leading edge. In other embodiments, the chamber-to-chord ratio of the leading edge of the fan blade is between 0 and 0.22, 0.05 and 0.17, or 0.08 and 0.13 (in different embodiments of the present invention). In still other embodiments, the chamber-to-chord ratio of the leading edge of the fan blade is between 0.05 and 0.30, 0.10 and 0.25, or 0.15 and 0.20 (in different embodiments of the present invention).

In a further aspect, the angle at which a trailing edge of the fan blade is swept forward is formed by a straight line having a length equal to $R_T$ extending from the axis of rotation of the fan assembly to the rearward position (mentioned above) and a line extending from the axis to a second position on the trailing edge of the blade and having a length equal to about $0.5R_T$, wherein $\propto_T$ is at least 30 degrees but less than 40 degrees. In other embodiments, this angle is formed by a straight line extending from the axis to the rearward position of the fan blade and a line extending from the axis to a second position on the trailing edge and having a length equal to about 0.65R, wherein R is the radius of the fan assembly and $\propto_T$ is between 10 and 35 degrees, 15 to 30 degrees, or 20 to 25 degrees (in different embodiments of the present invention). In still other embodiments, this angle is formed by a straight line extending from the axis to the rearward position of the fan blade and a line extending from the axis to a second position on the trailing edge and having a length equal to about 0.75R, wherein R is the radius of the fan assembly and $\propto_T$ is between 5 and 20 degrees, 5 to 15 degrees, or 8 to 12 degrees (in different embodiments of the present invention).

In another aspect, the chamber-to-chord ratio of the trailing edge of the fan blade in some embodiments is larger than about 0.10 but less than about 0.20, wherein $L_T$ is the length of a straight line from the second position to the rearward position and $H_T$ is the maximum distance from $L_T$ to the trailing edge as measured from a straight line perpendicular to $L_T$ and extending to the trailing edge. In other embodiments, the chamber-to-chord ratio of the trailing edge of the fan blade is between 0 and 0.20, 0.05 and 0.17, or 0.07 and 0.12 (in different embodiments of the present invention). In still other embodiments, the chamber-to-chord ratio of the trailing edge of the fan blade is between 0.05 and 0.20, 0.05 and 0.17, or 0.07 and 0.12 (in different embodiments of the present invention).

With regard to the chamber-to-chord ratios of cross-sections of the blade at various radial distances of the blade (from the rotational axis thereof), in some embodiments this camber-to-chord ratio falls between 2.0% and 7.5%, and can be constant or vary with increasing distance from the rotational axis of the fan assembly. In other embodiments, this camber-to-chord ratio falls between 4.0% and 13.5% and can be constant or vary with increasing distance from the rotational axis of the fan assembly. With regard to the angle of the outer radial portion of the blade (with respect to a plane passing perpendicularly through the rotational axis of the blade), this angle is between 4 and 15 degrees, 6 and 13 degrees, or 8 and 11 degrees (in different embodiments of the present invention). In other embodiments, this angle is between 5 and 18 degrees, 8 and 15 degrees, or 10 and 15 degrees (in different embodiments of the present invention).

Other features and advantages of the invention along with the organization and manner of operation thereof will become apparent to those skilled in the art upon review of the following detailed description, claims, and drawings, wherein like elements have like numerals throughout.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION

Figure 1:
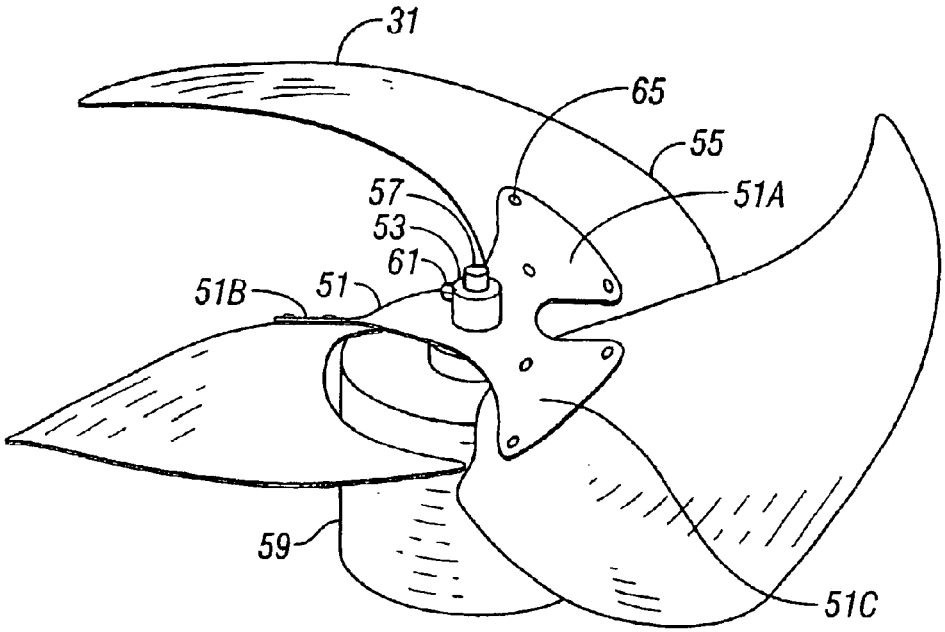
FIG. 1 is a perspective view of a fan assembly according to an embodiment of the present invention, shown attached to a shaft of a motor.
Figure 2:
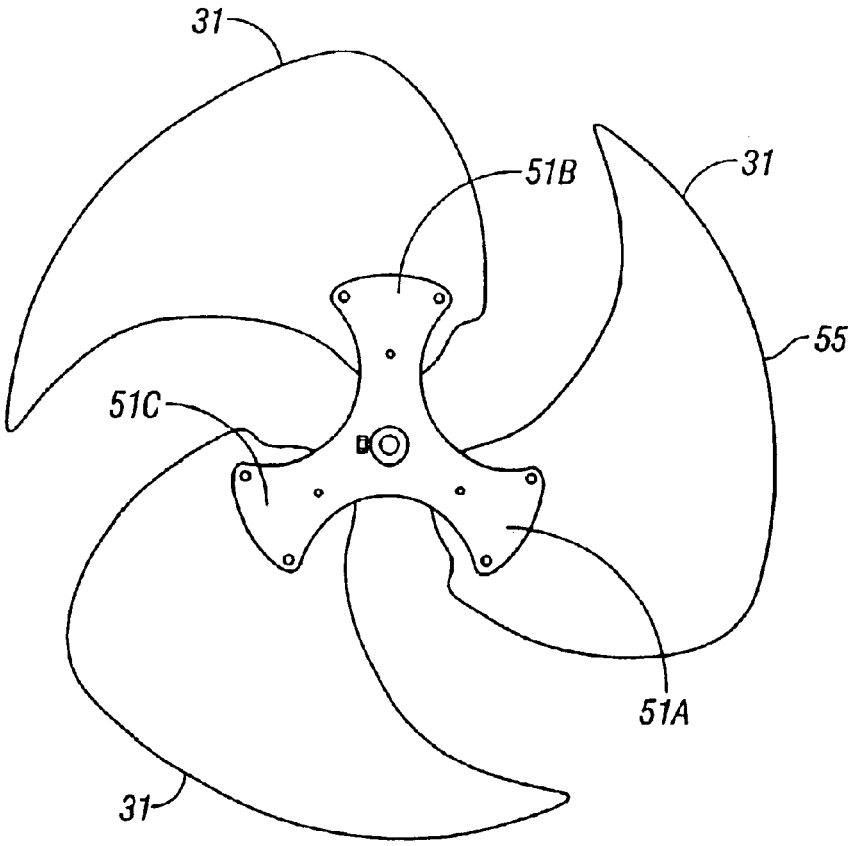
FIG. 2 is rear plan view of the fan assembly illustrated in FIG. 1, shown with the fan blades having no pitch.
Figure 3:
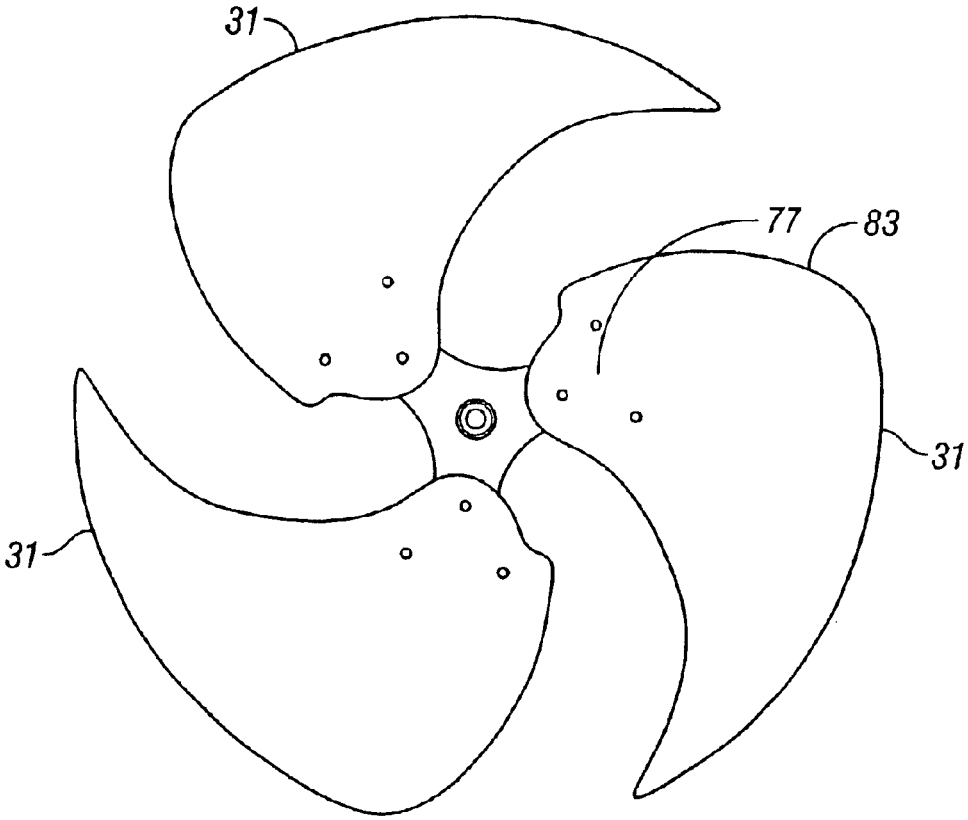
FIG. 3 is a front plan view of the fan assembly illustrated in FIGS. 1 and 2, shown with the fan blades having no pitch.
Figure 4:
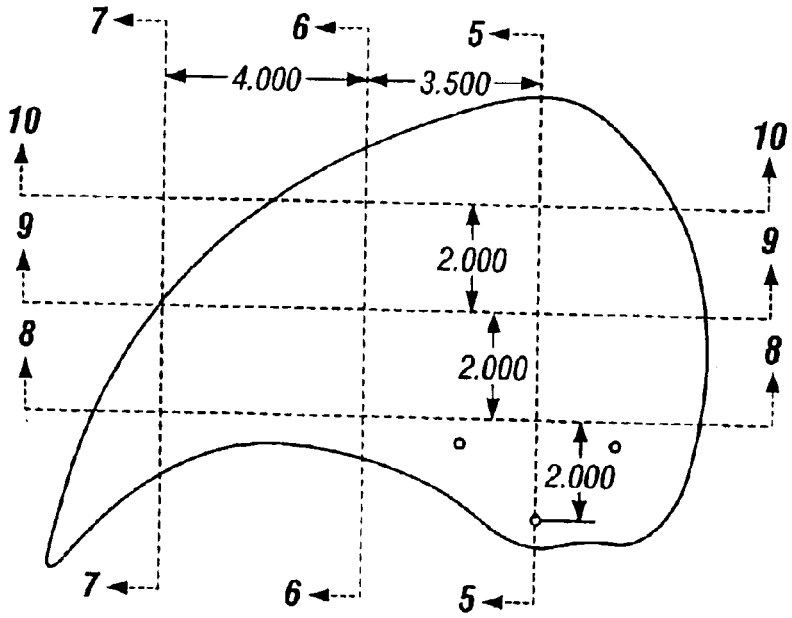
FIG. 4 is a rear plan view of one of the blades of the fan assembly illustrated in FIGS. 1-3.
Figure 5:
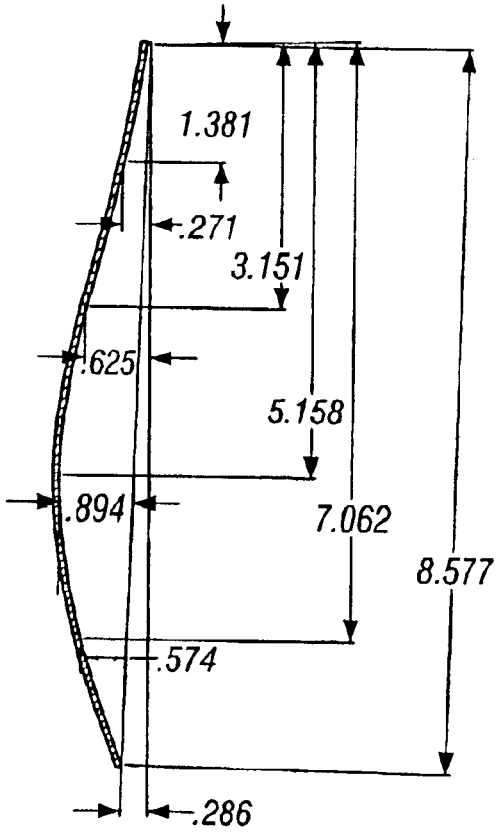
FIG. 5 is a cross-sectional view of the fan blade illustrated in FIG. 4, taken along lines A—A of FIG. 4.
Figure 6:
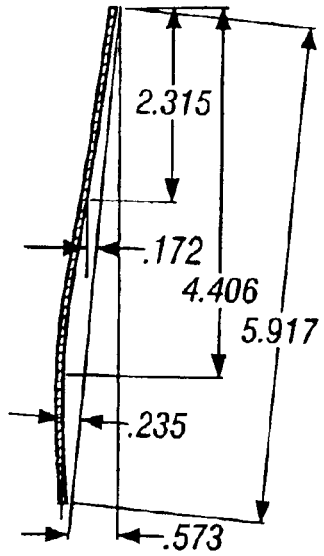
FIG. 6 is a cross-sectional view of the fan blade illustrated in FIG. 4, taken along lines B—B of FIG. 4.
Figure 7:
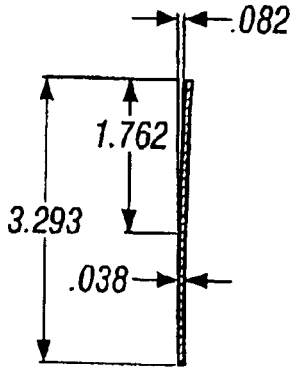
FIG. 7 is a cross-sectional view of the fan blade illustrated in FIG. 4, taken along lines C—C of FIG. 4.
Figure 8:
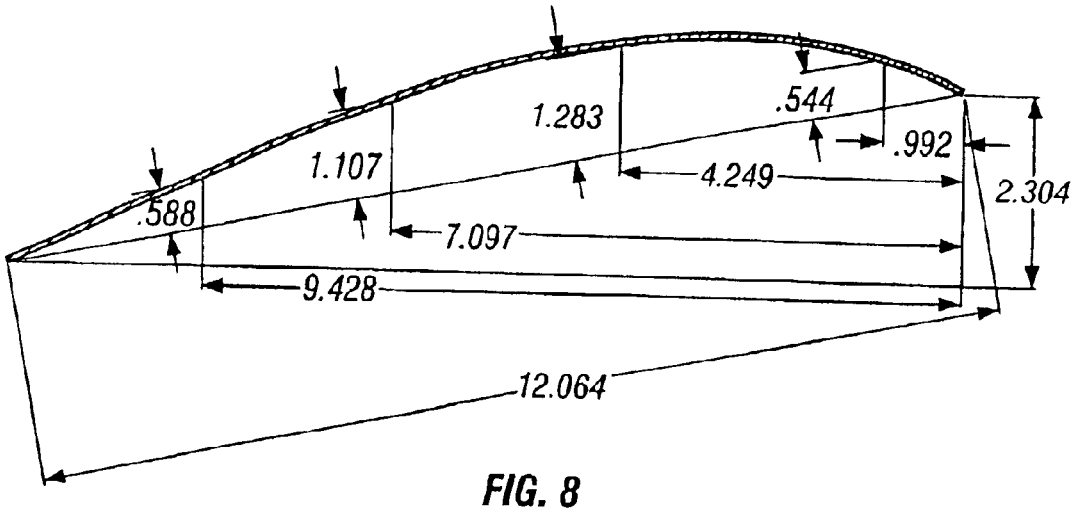
FIG. 8 is a cross-sectional view of the fan blade illustrated in FIG. 4, taken along lines D—D of FIG. 4.
Figure 9:
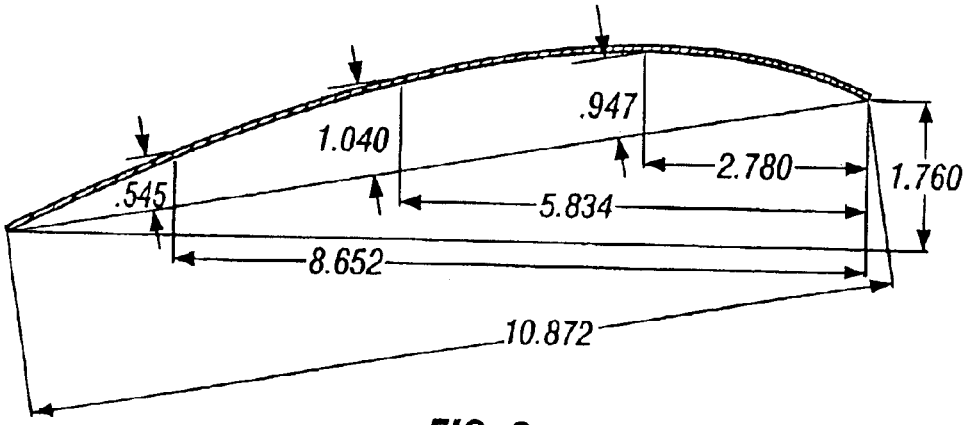
FIG. 9 is a cross-sectional view of the fan blade illustrated in FIG. 4, taken along lines E—E of FIG. 4.
Figure 10:
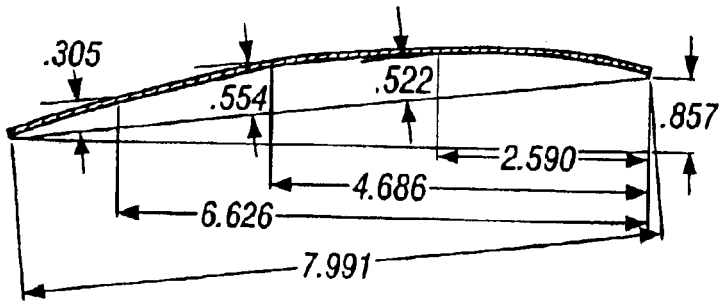
FIG. 10 is a cross-sectional view of the fan blade illustrated in FIG. 4, taken along lines F—F of FIG. 4.

Referring now to FIGS. 1-3, one embodiment of the fan blade according to the present invention is identified at 31. In this illustrated embodiment, three of the blades 31 are shown attached to an attachment device or spider 51 which is attached to a hollow cylindrical member 53 which forms a fan assembly 55. The member 53 is fitted around and attached to the shaft 57 of an electric motor 59 by way of a threaded member 61. The fan assembly 55 can be used for cooling a condenser, for moving air within, into, or out of a room, for cooling equipment in an enclosure, or for any other application where it is necessary or desirable to move air or other fluid. The fan assembly 55 illustrated in FIGS. 1-3 has three identical blades 31. However, it should be noted that the fan blades 31 according to the various embodiments of the present invention can be employed in fan assemblies having any number of fan blades 31, such as two, four, or more identical fan blades 31. Furthermore, although the fan blades in the various embodiments of the present invention produce excellent results in fan assemblies having a diameter of 10–24 inches, and also in fan assemblies having a diameter of 24–36 inches, it should be noted that the fan blades of the present invention can have any size desired (e.g., for fan assemblies having diameters greater than 36 inches, smaller than 10 inches, or having any diameter therebetween).

Each of the blades 31 can be formed from a flat metal blank. For example, the blades 31 can be stamped, pressed, or machined from such a blank. In other embodiments however, the blades 31 can be cast, molded, or manufactured in any other manner desired. The blades 31 can be made of metal, and in some embodiments are made of aluminum. Other blade materials include steel, plastic, composites, fiberglass, and the like.

In some embodiments, the blades 31 are bent or are otherwise shaped to have a generally concave rear side and a convex front side. Referring to FIG. 13, the blade 31 of the first embodiment illustrated in FIGS. 1-3 (as well as FIGS. 4-12 and 14) has an inner attachment portion 77, an outer edge 79, a curved leading edge 81 and a curved trailing edge 83. Other embodiments falling within the spirit and scope of the present invention can have less than all of these features (e.g., a leading edge 81 that is not curved, a trailing edge 83 that is not curved, and the like). The attachment portion 77 of the blade 31 can be attached to an arm 51A of a spider 51, which is attached to a hub 53, cylinder, or other element adapted to be mounted upon a motor shaft or other driving unit. Alternatively, the attachment portion 77 can be shaped to connect directly to the hub 53, if desired (in which case no identifiable spider 51 need exist). In this regard, the fan assembly 55 of the various embodiments of the present invention can be defined at least in part by one or more fan blades 31 that are integral with respect to the spider 51, or that are integral with respect to the spider 51 and hub 53. In such embodiments, the blades 31 and spider 51 (or the blades 31, spider 51, and hub 53) can be manufactured as an integral unit in any conventional manner, such as by pressing, stamping, molding, casting, and the like. Also, in some embodiments the blades 31 can be integral with respect to the hub 53 (in which case no identifiable spider 51 need exist). The fan assembly 55 can be connected to a driving unit in any conventional manner, such as by a splined shaft connection, a clearance, press, or interference fit upon a motor shaft, by being bolted or otherwise attached to a mounting plate driven in any conventional manner, and the like. In the illustrated embodiment of FIGS. 1-3 for example, the hub 53 has a central aperture 53A with a centerpoint 53C at an axis of rotation 63 of the fan assembly 55 (see FIGS. 11 and 12).

The shapes of the blades 31, 231 of the various embodiments of the present invention can be defined at least in part by one or more angles or lengths. Some of these angles or lengths include the radius of the fan assembly 55, 255, 455 at different locations on the blade ($R_L$ and $R_T$ described in greater detail below), a radius R of a circle that coincides or substantially coincides with a majority or all of the length of a trailing edge of the blade, an angle $\alpha_L$,$\alpha_l$, $\alpha_{l'}$ at which a leading edge of the fan blade is swept forward, an angle $\alpha_T$, $\alpha$t, $\alpha$t at which a trailing edge of the fan blade is swept forward, the chamber-to-chord ratio $H_L/L_L$, $H_l/L_l$, $H_{l'}/L_{l'}$ of the leading edge of the fan blade, the chamber-to-chord ratio $H_T/L_T$, $H_t/L_t$, $H_{t'}/L_{t'}$ of the trailing edge of the fan blade, the chamber-to-chord ratio H/L of a cross-section of the blade at various radial distances of the blade (from the rotational axis thereof), and an angle β, β', β" of the outer radial portion of the blade with respect to a plane passing perpendicularly through the rotational axis of the blade. Blades 31, 231, 431 falling within the spirit and scope of the present invention can be at least partially defined by the size of any one or more of these blade parameters. These blade parameters according to the present invention will be described in greater detail below.

The blade shapes and blade shape parameters hereinafter described with reference to the embodiments of the present invention illustrated in FIGS. 1-26 can be employed in blades having any size. However, superior performance is obtained by using these blade shapes and blade shape parameters in blade assemblies that are approximately 10–24 inches in diameter.

With reference again to the blade embodiment illustrated in FIG. 13, the arcs of the blade edges 79 and 81 join at a forward position at juncture 85, while the arcs of the blade edges 79 and 83 join at a rearward position at juncture 87. Accordingly, the outer edge 79 of the blade 31 defines an arc from point 85 to juncture 87, although other shapes for the outer edge 79 can be employed in alternative embodiments of the present invention. The leading edge 81 of the blade illustrated in FIG. 13 is forward swept in a region between point 91 and point 85. Point 91 is defined as the location where the leading edge 81 of the blade 31 intersects an imaginary circle centered about the rotational axis 63 of the blade 31 and having a radius that is one-half of the radius of the fan assembly 255 at the tip 233 of the blade 31 ($0.5R_L$). Point 85 is defined as the location where the leading edge 81 and the outer edge 79 would intersect if their respective arcs were extended (in those embodiments such as the illustrated embodiment of FIGS. 1-14 in which point 85 is located off of the blade 31.

The trailing edge 83 of the blade illustrated in FIG. 13 is a forward swept region between point 93 and point 87. Point 93 is defined as the location where the trailing edge 83 of the blade 31 intersects an imaginary circle centered about the rotational axis 63 of the blade 31 and having a radius that is one-half of the radius of the fan assembly 55 at point 93 ($0.5R_T$). Point 87 is defined as the location where the outer edge 79 meets the trailing edge 83, and in some embodiments is the rearmost location of the blade 31 that has a radius substantially the same as the radius of the fan assembly 55. In some embodiments (such as the embodiment illustrated in FIGS. 17-26 described in greater detail below), the trailing edge 83 is defined in either manner just described or in another manner dependent at least partially upon the shape of the trailing edge 83. With regard to this third manner, some blades 31 employ a trailing edge 83 that has a substantially constant radius over at least a majority (and in many cases, a large majority or all) of the trailing edge 83. In some embodiments, the arc defined by this portion of the trailing edge 83 intersects or can be extended to intersect an imaginary circle having the radius R of the fan assembly 55. This point of intersection 87 can be on or off of the blade 31, and represents another manner of defining point 87 according to the present invention.

The leading edge 81 of the blade 31 in the embodiment of FIGS. 1-14 has a swept angle $\propto_L$ formed by and between lines 95 and 97. Line 95 has a length equal to $R_L$ and is an imaginary straight line passing from the axis of rotation 63 of the fan assembly 55 to point 85, while line 97 is an imaginary straight line passing from the axis of rotation 63 to point 91. In some embodiments of the present invention (including the blade embodiment illustrated in FIGS. 1-14), $\propto_L$ is at least about 35 degrees.

The fan blade leading edge 81 in the region between points 91 and 85 can be concave as illustrated in FIGS. 1-14, and can have a camber ratio defined by the largest depth $H_L$ of the fan blade leading edge 81 between points 91 and 85 divided by the length of a straight line $L_L$ extending between points 91 and 85 ($H_L$ being measured perpendicular to $L_L$). In some embodiments of the present invention, the camber-to-chord ratio $H_L L_L$ is larger than 0.10 but less than 0.20.

As mentioned above, the trailing edge 83 of the fan blade 31 illustrated in FIGS. 1-14 is forwardly swept in the region between points 93 and 87. More specifically, the fan blade 31 in the embodiment of FIGS. 1-14 has a swept angle $\propto_T$ formed by and between lines 99 and 101. Line 99 is an imaginary straight line passing from the axis of rotation 63 of the fan assembly 55 to point 93, while line 101 has a length equal to the radius of the fan assembly 55 at point 87, $R_T$, and is an imaginary straight line passing from the axis of rotation 63 to point 87. In some embodiments of the present invention, $\propto_T$ is at least about 30 degrees but less than about 40 degrees. The radius of the fan assembly $R_T$ (at point 87) can be the same or different than the radius of the fan assembly $R_L$ (at point 85).

The fan blade trailing edge 83 can be convex, and can have a camber ratio defined by the largest height of the fan blade trailing edge 83 between points 87 and 93 divided by the length of a straight line $L_T$ extending between points 87 and 93 ($H_T$ measured perpendicular to $L_T$). In some embodiments of the present invention, the camber-to-chord ratio $H_T/L_T$ is larger than 0.10 but less than 0.20. With particular reference to FIG. 13, line 88 is an imaginary straight line extending radially from the axis of rotation 63 of the fan assembly 55 along the middle of the wing 51A of the spider.

Figure 12:
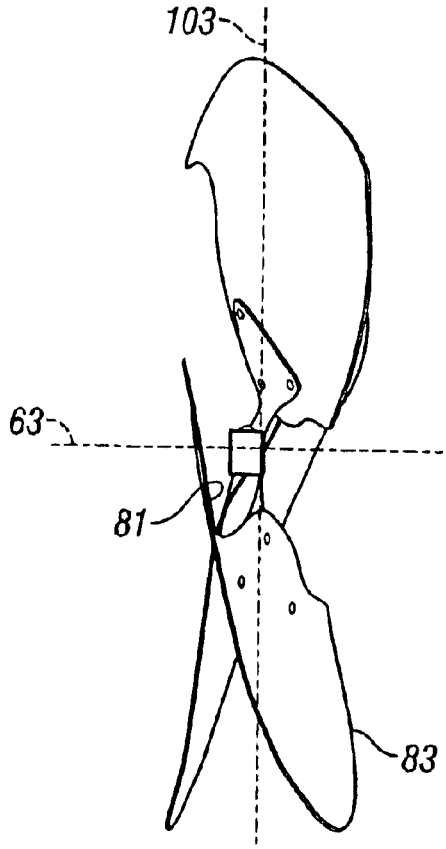
FIG. 12 is a side view of the fan assembly illustrated in FIGS. 1-3.
Figure 13:
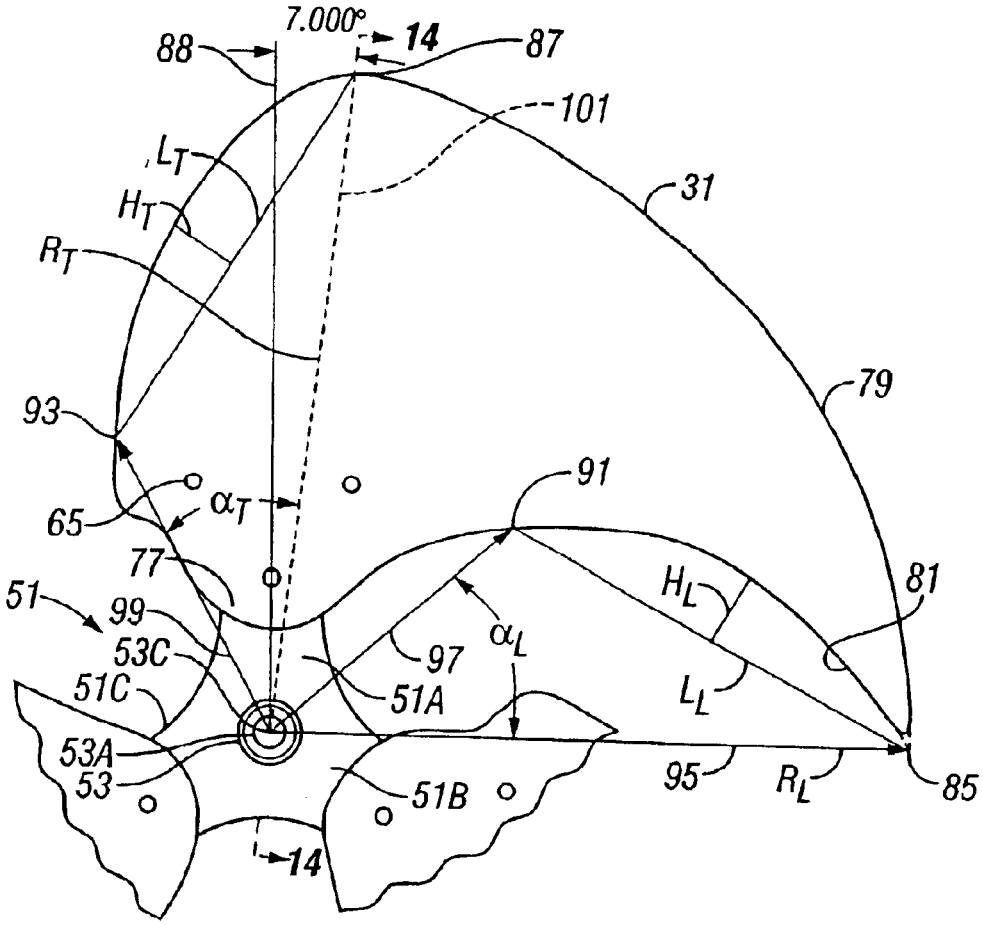
FIG. 13 is a front plan view of one of the blades of the fan assembly illustrated in FIGS. 1-3, shown attached to a spider having no pitch.
Figure 14:
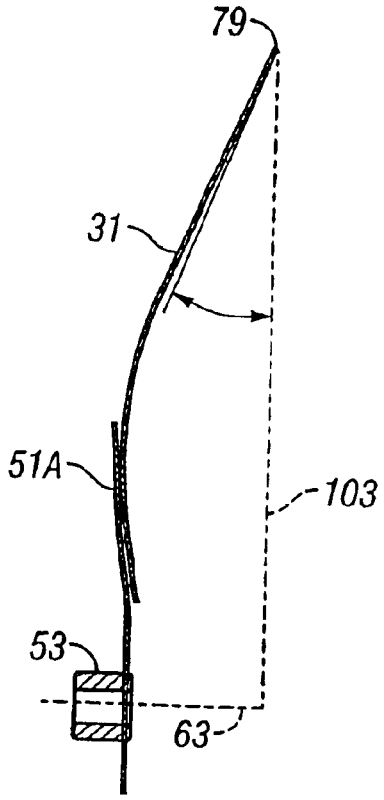
FIG. 14 is a cross-sectional view of the fan blade illustrated in FIG. 13, taken along lines M—M of FIG. 13.

The blade 31 can have any cross-sectional shape desired (i.e., any shape into and out of the plane of FIGS. 2-4 and 13). However, in some embodiments, the blade 31 is shaped such that the surface of the front side is concave and the surface of the rear side is convex as shown in FIGS. 5-14. With reference to FIG. 14, this shape can be measured with reference to an imaginary line 103 extending radially inward from point 87 at the outer edge 79 of the blade 31 to intersect the axis of rotation 63 of the fan assembly 55 in a perpendicular manner. In some embodiments of the present invention, the angle β (the angle between line 103 and the blade in the radially outer region of the blade 31) is at least 10 degrees. In this regard, the radially outer third to half of the blade 31 at line 103 can be flat or substantially flat as best shown in FIG. 14. Accordingly, in such embodiments, the angle β is defined between this portion of the blade 31 and line 103.

Figure 11:
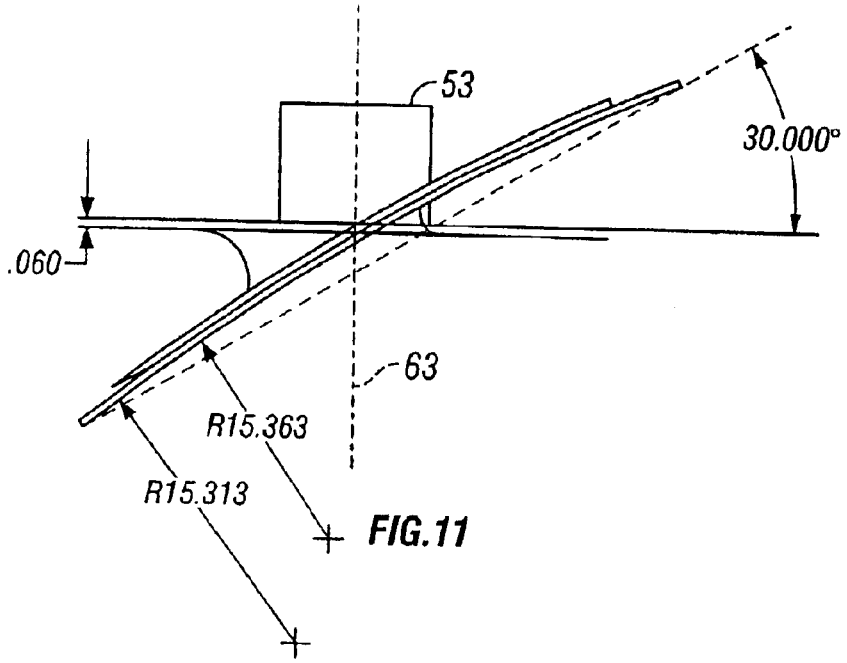
FIG. 11 is an end view of one of the fan blades illustrated in FIGS. 1-3, shown mounted upon a motor shaft.

The spider 51 in the illustrated preferred embodiment of FIGS. 1, 2, 3, 12, and 13 has three arms or wings, 51A, 51B, and 51C, each of which extend outward from the axis of rotation 63. The spider arms 51A, 51B, 51C can extend from the axis of rotation 63 at a pitch angle as best shown in FIG. 11. Any pitch angle of the blades 31 can be selected. In some embodiments, the spider arms 51A, 51B, 51C extend at no pitch angle.

Each of the blades 31 is attached to one of the spider arms 51A, 51B, 51C in any conventional manner, such as by bolts 65, rivets, screws, or other conventional fasteners, welding or brazing, adhesive or cohesive bonding material, and the like. With continued reference to the embodiment illustrated in FIGS. 1, 2, 3, 12, and 13, and with particular reference to FIG. 13, the spider arms 51A, 51B, 51C (only one of which is shown completely in FIG. 13) are spaced apart from one another, such as by 120 degrees between arms as illustrated, or by any other regular or non-regular spacing. Accordingly, adjacent blades can be angularly separated corresponding to the separation of the spider arms, such as by 120 degrees in the embodiment of FIGS. 1, 2, 3, 12, and 13.

As shown in FIG. 12, the trailing edge 83 of each blade 31 in the illustrated embodiment of FIGS. 1-14 is forward of a plane 103 perpendicular to the axis 63 and passing through the spider 51, while the leading edge 81 of each of the blades is rearward of the plane 103. This arrangement of the blades 31 is dependent at least in part upon the shape of the blades 31 and the spider arms 51A, 51B, 51C (e.g., the pitch of the spider arms 51A, 51B, 51C).

Figure 16:
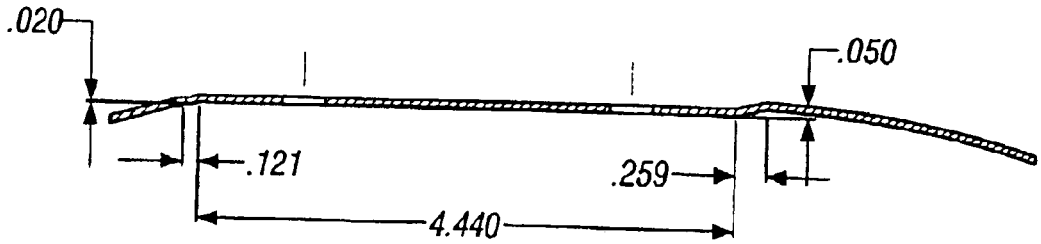
FIG. 16 is cross-sectional view of the fan blade illustrated in FIG. 15, taken along lines N—N of FIG. 15.
Figure 15:
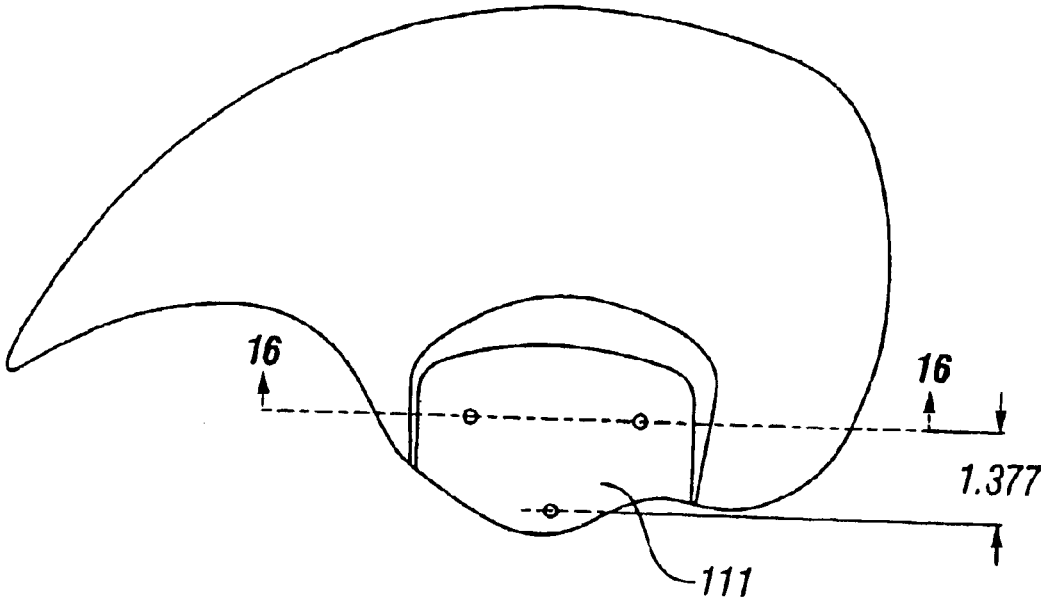
FIG. 15 is a rear plan view of a fan blade according to a second embodiment of the present invention.

Another embodiment of the fan blade 31 according to present invention is illustrated in FIGS. 15 and 16. In this embodiment, the fan blade 31 shares the same features as the blade illustrated in FIGS. 1-14, but has a substantially flat mounting portion or pad 111 by which the spider 51 can be attached to the fan blade 31. In this regard, it should be noted that the spider 51 can be attached on the front side, rear side, or on both sides of the fan blade 31 at this mounting portion or pad 111.

Yet another embodiment of the fan blade according to the present invention is illustrated in FIGS. 17-26. With the exception of differences evident from a comparison of FIGS. 1-16 and 17-26 and the differences indicated below, the fan blade (indicated generally at 231) has the same features as those described above with reference to the blade embodiments shown in FIGS. 1-16. Accordingly, features of the fan blade 231 corresponding to those of the embodiments of FIGS. 1-16 are assigned the same numbers increased by 200.

Figure 17:
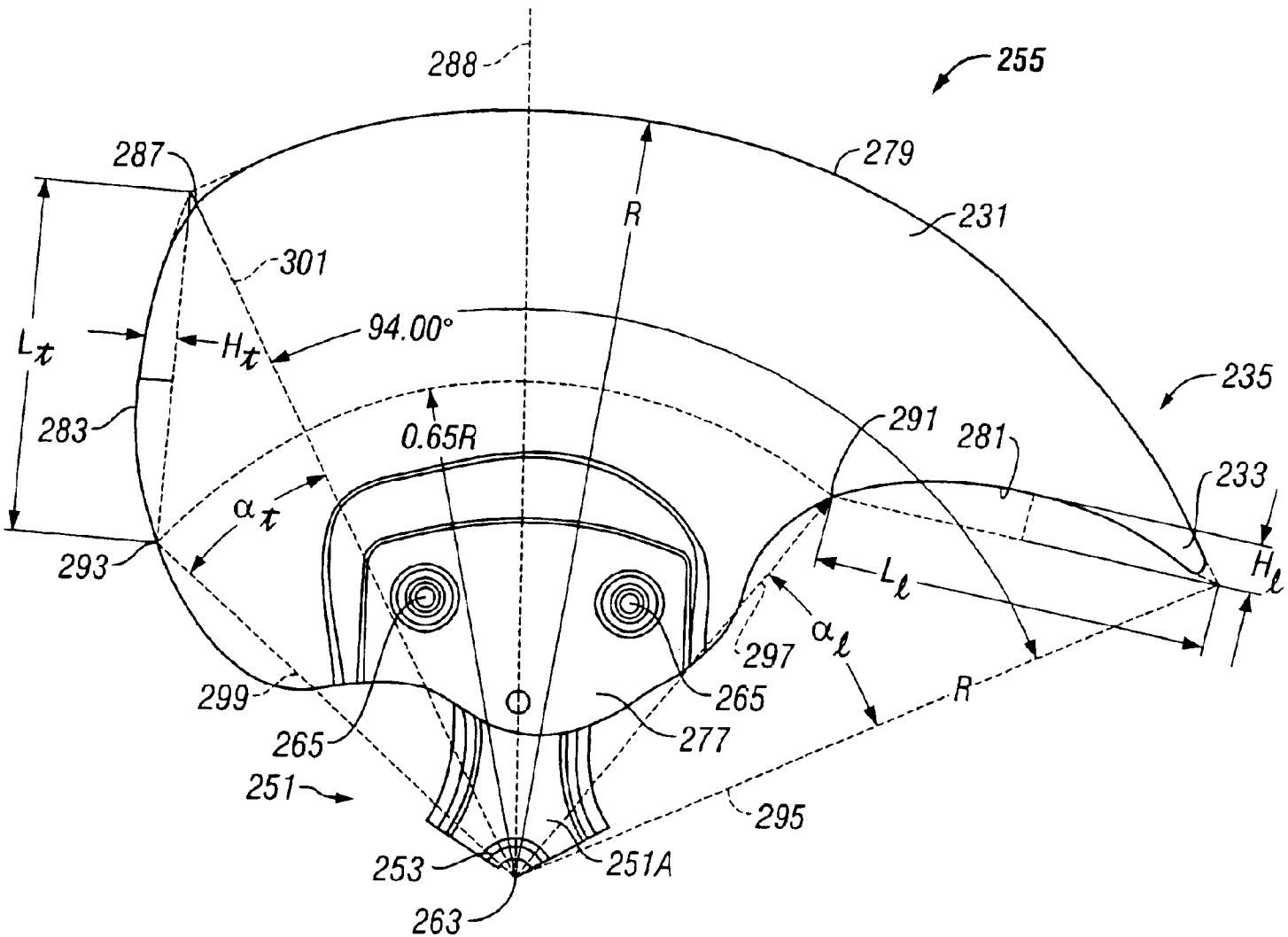
FIG. 17 is a front plan view of a fan blade according to a third embodiment of the present invention, shown attached to a spider having no pitch.
Figure 18:
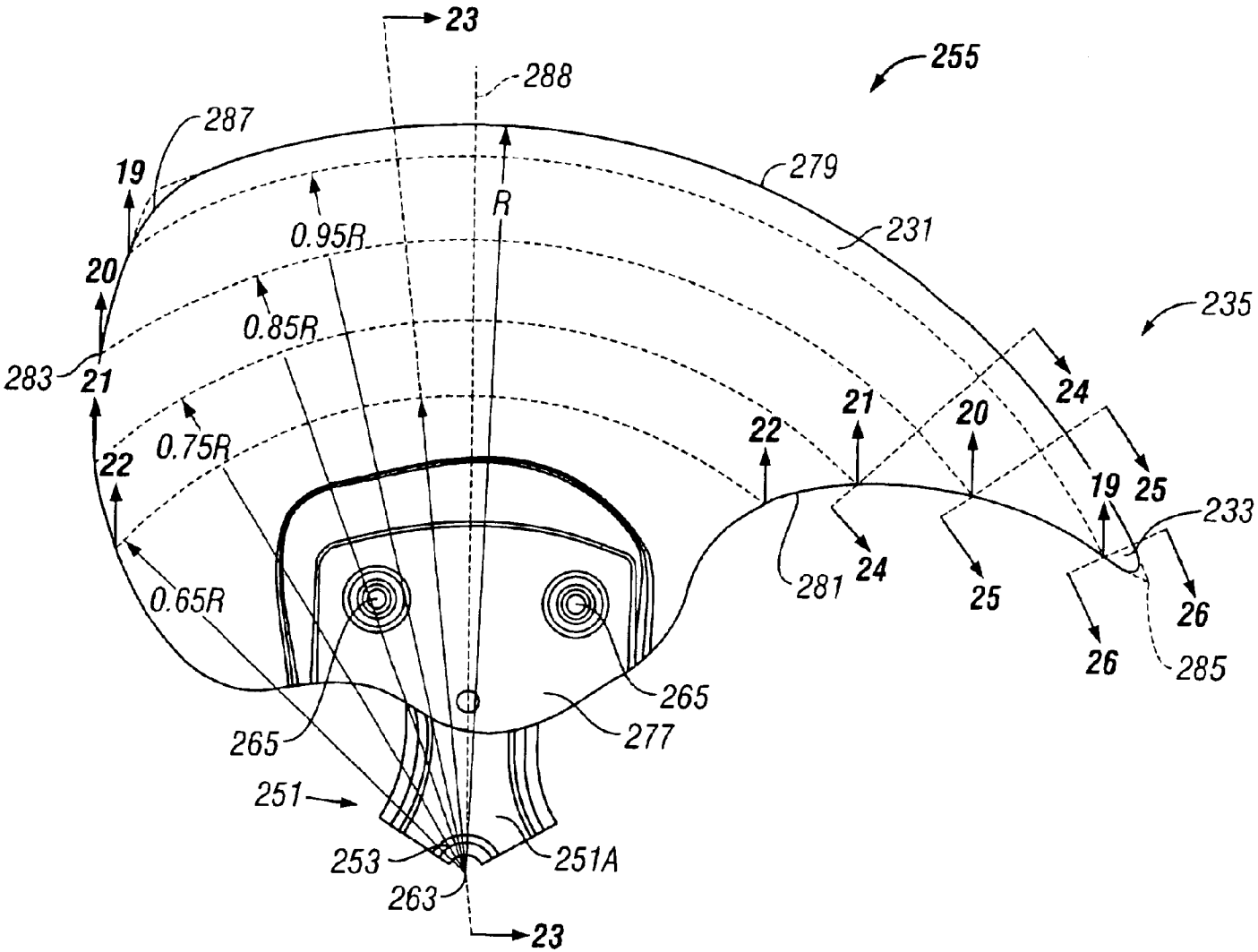
FIG. 18 is a front plan view of the fan blade illustrated in FIG. 17.
Figure 19:
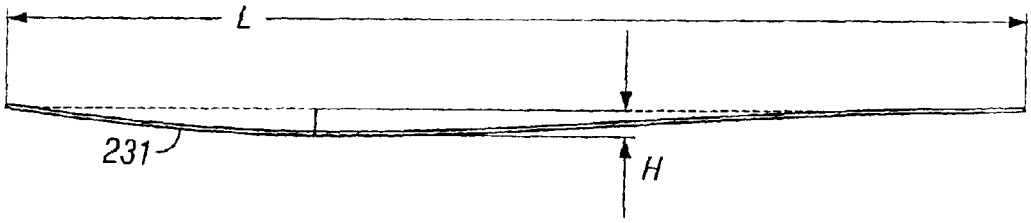
FIG. 19 is a cross-sectional view of the fan blade illustrated in FIGS. 17 and 18, taken along lines A—A of FIG. 19.
Figure 20:
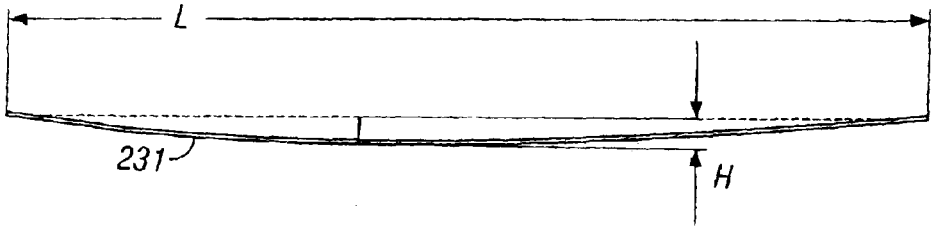
FIG. 20 is a cross-sectional view of the fan blade illustrated in FIGS. 17 and 18, taken along lines B—B of FIG. 19.
Figure 21:
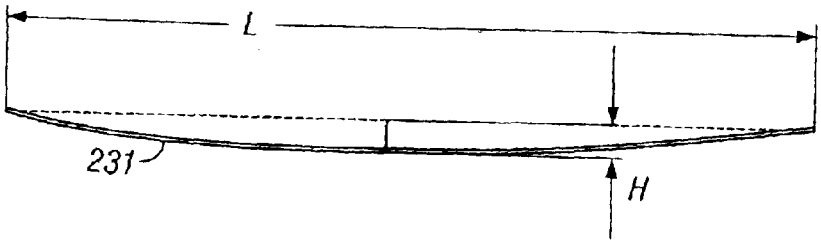
FIG. 21 is a cross-sectional view of the fan blade illustrated in FIGS. 17 and 18, taken along lines C—C of FIG. 19.
Figure 22:
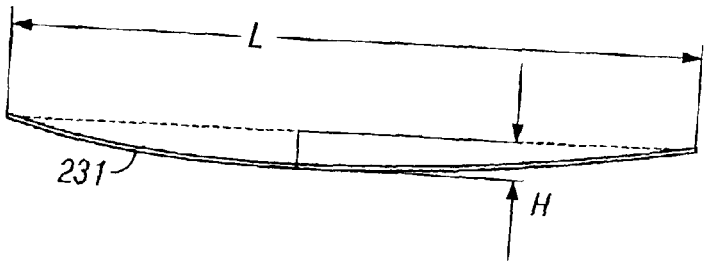
FIG. 22 is a cross-sectional view of the fan blade illustrated in FIGS. 17 and 18, taken along lines D—D of FIG. 19.
Figure 23:
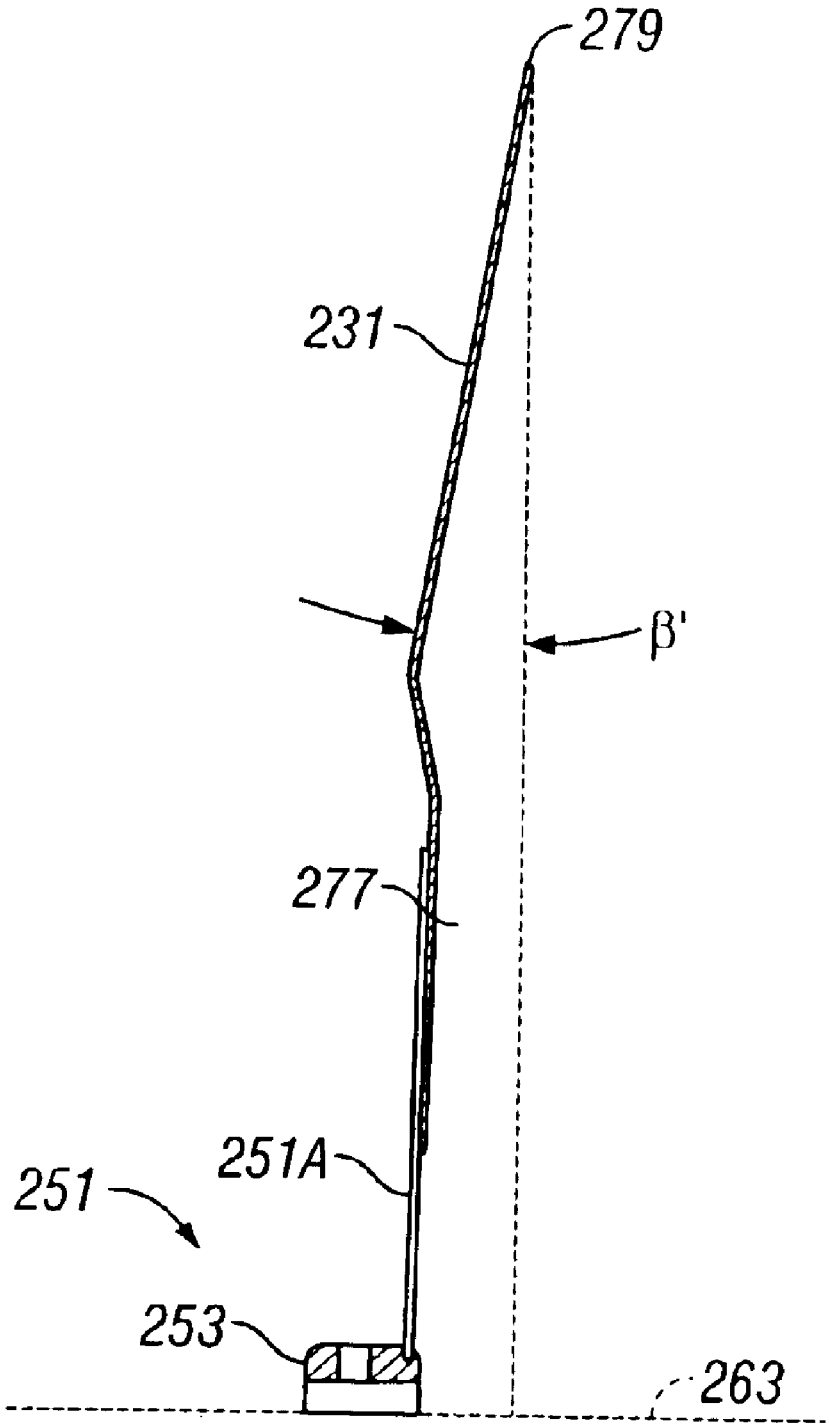
FIG. 23 is a cross-sectional view of the fan blade illustrated in FIGS. 17 and 18, taken along lines E—E of FIG. 19.
Figure 24:
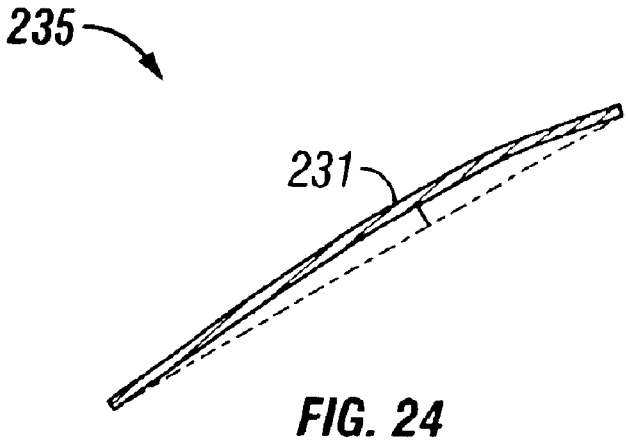
FIG. 24 is a cross-sectional view of the fan blade illustrated in FIGS. 17 and 18, taken along lines F—F of FIG. 19.
Figure 25:
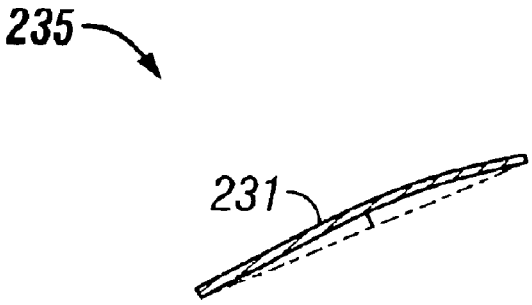
FIG. 25 is a cross-sectional view of the fan blade illustrated in FIGS. 17 and 18, taken along lines G—G of FIG. 19.
Figure 26:
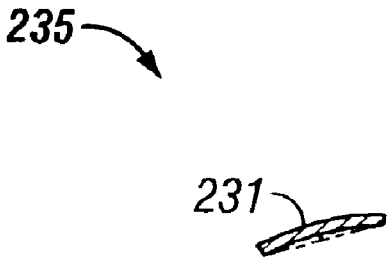
FIG. 26 is a cross-sectional view of the fan blade illustrated in FIGS. 17 and 18, taken along lines H—H of FIG. 19.

The blade 231 illustrated in FIGS. 17-26 has an extended trailing edge 283 as best shown in FIGS. 17 and 18. In addition, the outer edge 279 of the blade 231 has a substantially constant radius along a majority of (and in the illustrated embodiment of FIGS. 17-26, almost all of) the outer edge 279 of the blade 231 between points 285 and 287. However, the blade 231 in the illustrated embodiment of FIGS. 17-26 has a slightly smaller radial dimension near point 287 as shown in FIGS. 17 and 18, where it can be seen that a circle having a constant radius R extends past the edge of the blade 231 at point 287. In addition, point 291 in the embodiment of FIGS. 17-26 is defined as the location where the leading edge 281 of the blade 231 intersects an imaginary circle centered about the rotational axis 263 of the blade 231 and having a radius that is 0.65 times the length of the radius of the blade assembly (0.65R). Similarly, point 293 is defined as the location where the trailing edge 283 of the blade 231 intersects an imaginary circle centered about the rotational axis 263 of the blade 231 and having a radius that is 0.65 times the length of the radius of the blade assembly (0.65R).

As described above, the shape of the blade 231 according to the present invention can be defined by any one or more parameters. In this regard, any combination of such parameters can be employed to define a blade 231 according to the present invention. With continued reference to FIGS. 17-26, the angle $\alpha_1$ (at which the leading edge 281 of the fan blade 231 is swept forward) falls between 15 and 45 degrees in some applications to produce good fan performance. In other applications, a leading edge angle $\alpha_1$ falling between 20 and 35 degrees is employed for good fan performance. In still other applications, a leading edge angle $\alpha_1$ falling between 25 and 30 degrees is employed for good fan performance.

With reference now to the trailing angle $\alpha_1$ (at which the trailing edge 283 of the fan blade 231 is swept forward), the trailing angle $\alpha_1$ falls between 10 and 35 degrees in some applications to produce good fan performance. In other applications, a trailing edge angle $\alpha_t$ falling between 15 and 30 degrees is employed for good fan performance. In still other applications, a trailing edge angle $\alpha_1$ falling between 20 and 25 degrees is employed for good fan performance.

As described above, the blade 231 can have a concave leading edge 281 having a chamber-to-chord ratio $H_l/L_l$. This chamber-to-chord ratio $H_l/L_l$ is between 0 and 0.22 in some applications to produce good fan performance. In other applications, a leading edge chamber-to-chord ratio $H_l/L_l$ falling between 0.05 and 0.17 is employed for good fan performance. In still other applications, a leading edge chamber-to-chord ratio $H_l/L_l$ falling between 0.08 and 0.13 is employed for good fan performance.

With reference now to the chamber-to-chord ratio $H_t/L_t$ of the trailing edge 283, the chamber-to-chord ratio $H_t/L_t$ of the trailing edge 283 falls between 0 and 0.20 in some applications to produce good fan performance. In other applications, a trailing edge chamber-to-chord ratio $H_t/L_t$ falling between 0.05 and 0.17 is employed for good fan performance. In still other applications, a trailing edge chamber-to-chord ratio $H_t/L_t$ falling between 0.07 and 0.12 is employed for good fan performance.

As also described above, the blade 231 can have a concave front side and can have a cross-sectional shape taken along line 203 that is flat or substantially flat along the outer radial portion of the blade 231. This flat or substantially flat portion of cross-section can be along the radially-outermost 25% of the blade 231 or along a larger radially-outermost portion of the blade 231 (such as the radially outermost half of the blade 231 in the embodiment of FIGS. 17-26) as desired, and can be at an angle β' with respect to a plane orthogonal to the rotational axis 63. This angle β' falls between 4 and 15 degrees in some applications to produce good fan performance. In other applications, this angle β' falls between 6 and 13 degrees for good fan performance. In still other applications, this angle β' falls between 8 and 11 degrees for good fan performance.

With reference again to FIGS. 17 and 18, cross-sections of the fan blade 231 can be taken at different radial distances from the rotational axis 263 of the fan assembly 255. In some embodiments of the present invention, the cross-sectional shapes of the blade 231 at such cross-sections changes with increasing distance from the rotational axis 263 of the fan assembly 255. In the illustrated embodiment of FIGS. 17-26 (and in still other embodiments of the present invention), these cross-sectional shapes are bowed, and define a camber-to-chord ratio H/L. In some embodiments, this camber-to-chord ratio H/L decreases with increasing distance from the rotational axis 263. For example, the camber-to-chord ratio H/L can decrease from 0.65R to the outer edge 79 of the blade 231 for good fan performance.

With reference now to FIGS. 17-22, the cross-sectional shape of the blade 231 at different radial locations of the blade 231 can be quantified in terms of camber to chord ratios H/L. In some applications, this camber-to-chord ratio H/L of the blade 231 at a radial distance of 0.95R falls between 2.0% and 5.5% for good fan performance. In other applications, this camber-to-chord ratio H/L falls between 2.5% and 4.5% for good fan performance. In still other applications, this camber-to-chord ratio H/L falls between 3.0% and 4.0% for good fan performance.

At a radial distance of 0.85R, the camber-to-chord ratio H/L of the blade 231 in some embodiments falls between 3.0% and 6.5% for good fan performance. In other applications, this camber-to-chord ratio H/L falls between 3.0% and 5.0% for good fan performance. In still other applications, this camber-to-chord ratio H/L falls between 3.5% and 4.5% for good fan performance.

At a radial distance of 0.75R, the camber-to-chord ratio H/L of the blade 231 in some embodiments falls between 3.5% and 7.0% for good fan performance. In other applications, this camber-to-chord ratio H/L falls between 4.0% and 6.0% for good fan performance. In still other applications, this camber-to-chord ratio H/L falls between 4.5% and 5.5% for good fan performance.

At a radial distance of 0.65R, the camber-to-chord ratio H/L of the blade 231 in some embodiments falls between 4.0% and 7.5% for good fan performance. In other applications, this camber-to-chord ratio H/L falls between 4.5% and 6.5% for good fan performance. In still other applications, this camber-to-chord ratio H/L falls between 5.0% and 6.0% for good fan performance.

In some embodiments of the present invention, additional strength and desirable airflow characteristics are obtained by employing a blade tip section 235 that is not flat. Specifically, and with particular reference to FIGS. 18 and 24-26, the portion of the blade 231 that is adjacent to the tip 233 (such as the forwardmost 10–30% of the blade 231 with respect to the rotation of the blade 231) can be shaped to have a concave or convex cross-sectional shape, and in this regard can have a curved or angled cross-sectional shape formed in any manner desired. For example, the tip section 235 of the blade 231 can be stamped, embossed, machined, molded, pressed, or formed in any other manner to produce a curved or angled cross-sectional shape. The curved or angled cross-sectional shape can be constant or substantially constant across the tip section 235 of the blade 231 (i.e., in a direction away from the tip 233 and between the outer and leading edges 279, 281 of the blade 231), or can instead have a varying cross-sectional shape from the tip 233. In the illustrated preferred embodiment of FIGS. 17-26, the tip section 235 of the blade 231 has a concave cross-sectional shape on the front side of the blade 231 (also presenting a convex shape on the rear side of the blade 231).

As noted above, although the shapes of the fan blades 31, 231 described above with reference to the embodiments of FIGS. 1-26 can be employed in blades having any size, superior results of these fan blade shapes have been obtained in fan assemblies having a diameter of between approximately 10 and 24 inches.

Another embodiment of the fan blade according to the present invention is illustrated in FIGS. 27-36. With the exception of differences evident from a comparison of FIGS. 1-16, 17-26, and the differences indicated below, the fan blade (indicated generally at 431) has the same features as those described above with reference to the blade embodiments shown in FIGS. 1-16 and FIGS. 17-26. Accordingly, features of the fan blade 431 corresponding to those of the embodiments of FIGS. 17-26 are assigned the same numbers as those in the embodiment illustrated in FIGS. 17-26, increased by 200.

The blade shapes and blade shape parameters hereinafter described with reference to the embodiment of the present invention illustrated in FIGS. 17-36 can be employed in blades having any size. However, superior performance is obtained by using these blade shapes and blade shape parameters in blade assemblies that are approximately 24–36 inches in diameter.

Figure 27:
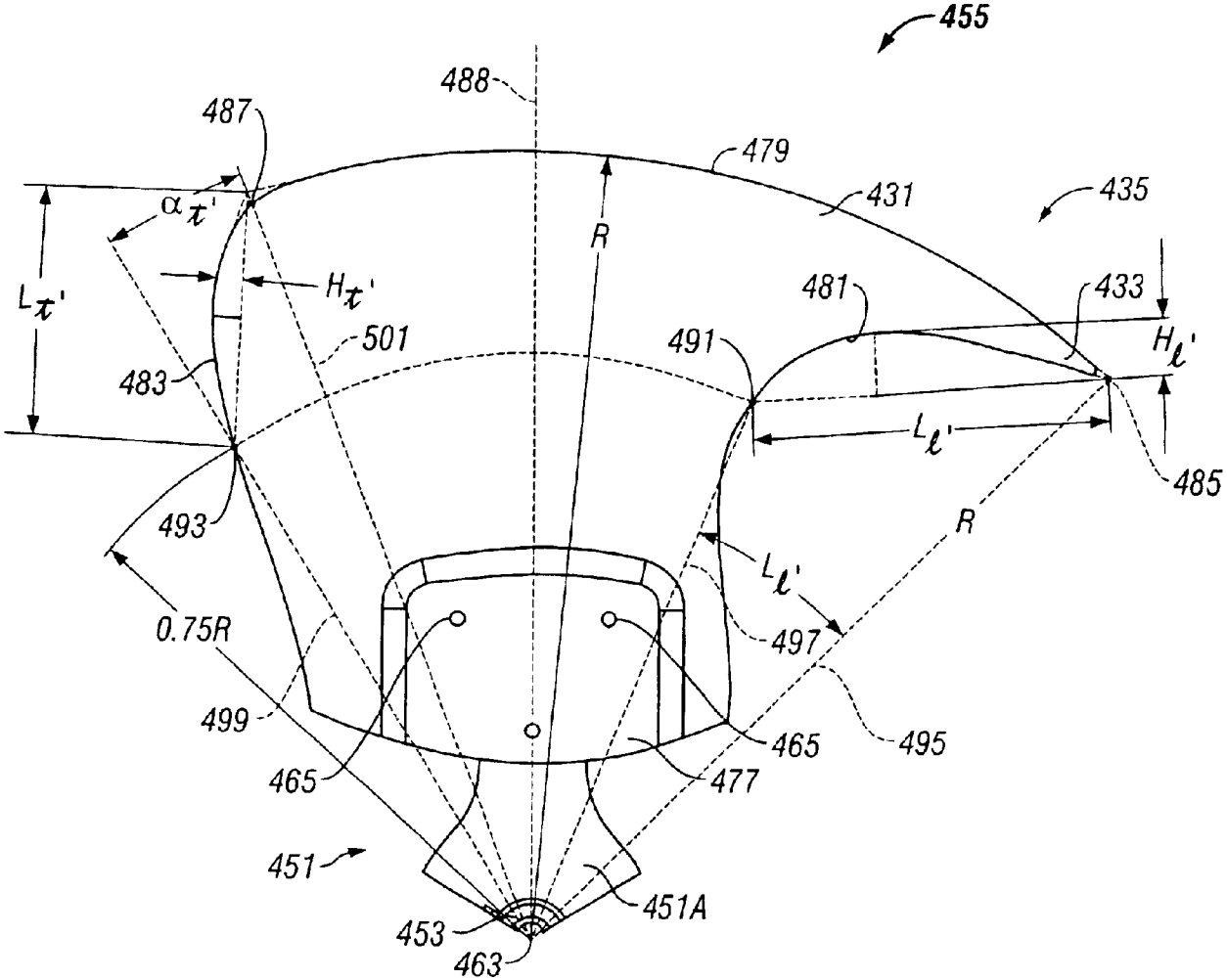
FIG. 27 is a front plan view of a fan blade according to a fourth embodiment of the present invention, shown attached to a spider having no pitch.
Figure 28:
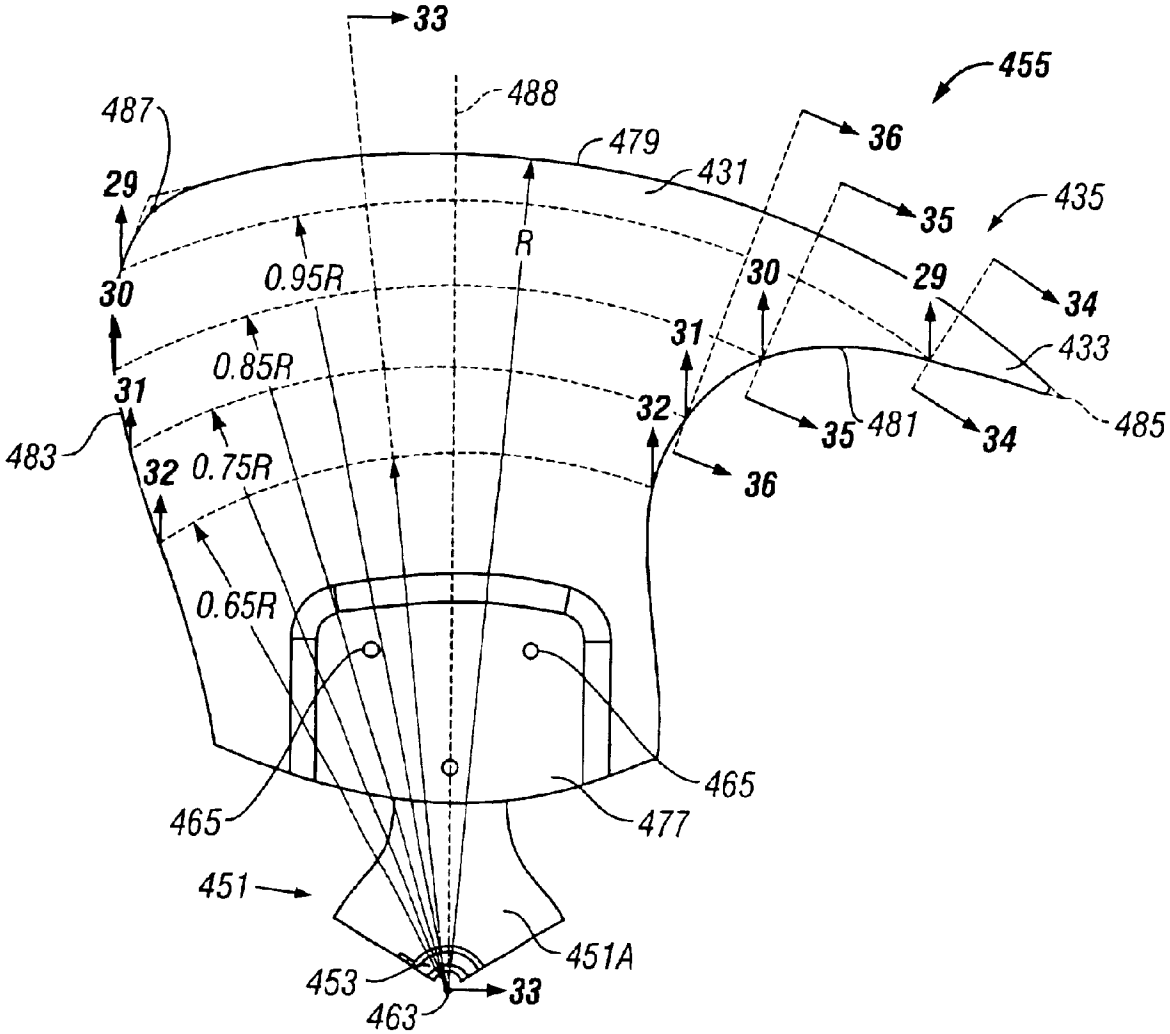
FIG. 28 is a front plan view of the fan blade illustrated in FIG. 27.
Figure 29:
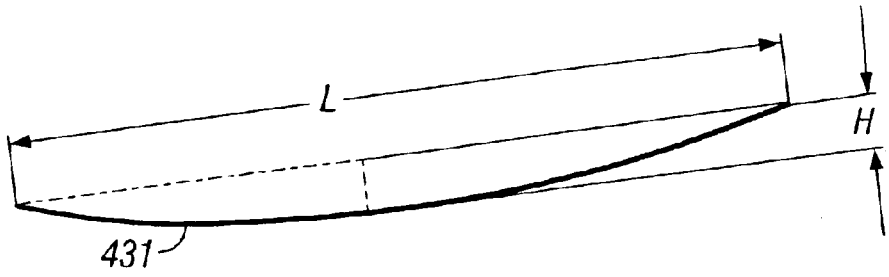
FIG. 29 is a cross-sectional view of the fan blade illustrated in FIGS. 27 and 28, taken along lines A—A of FIG. 28.
Figure 30:
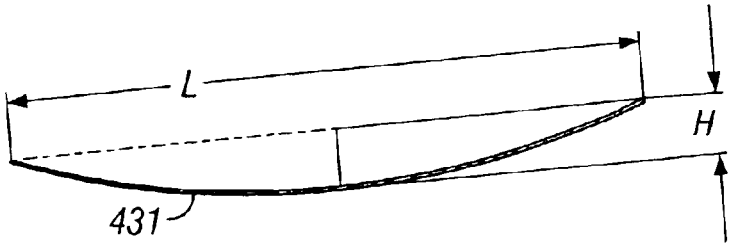
FIG. 30 is a cross-sectional view of the fan blade illustrated in FIGS. 27 and 28, taken along lines B—B of FIG. 28.
Figure 31:
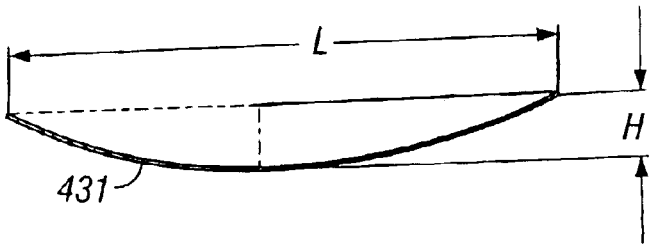
FIG. 31 is a cross-sectional view of the fan blade illustrated in FIGS. 27 and 28, taken along lines C—C of FIG. 28.
Figure 32:
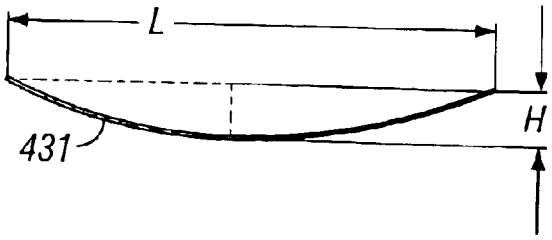
FIG. 32 is a cross-sectional view of the fan blade illustrated in FIGS. 27 and 28, taken along lines D—D of FIG. 28.
Figure 33:
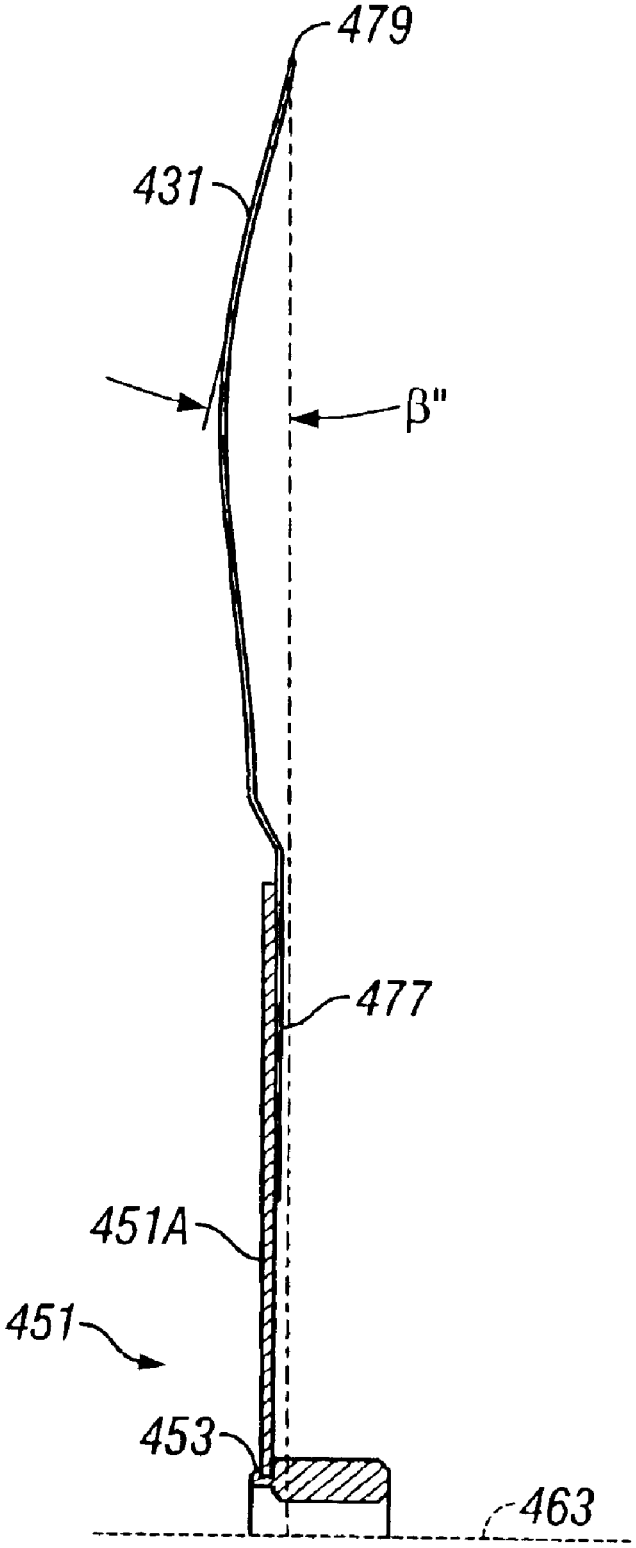
FIG. 33 is a cross-sectional view of the fan blade illustrated in FIGS. 27 and 28, taken along lines E—E of FIG. 28.
Figure 34:
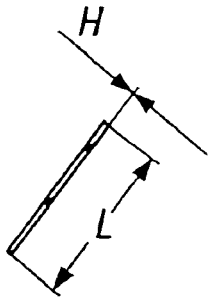
FIG. 34 is a cross-sectional view of the fan blade illustrated in FIGS. 27 and 28, taken along lines F—F of FIG. 28.
Figure 35:
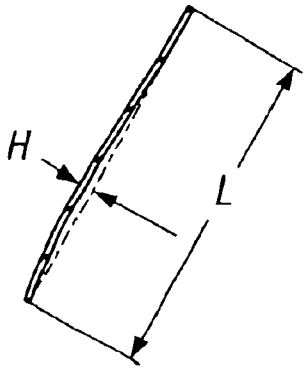
FIG. 35 is a cross-sectional view of the fan blade illustrated in FIGS. 27 and 28, taken along lines G—G of FIG. 28.
Figure 36:
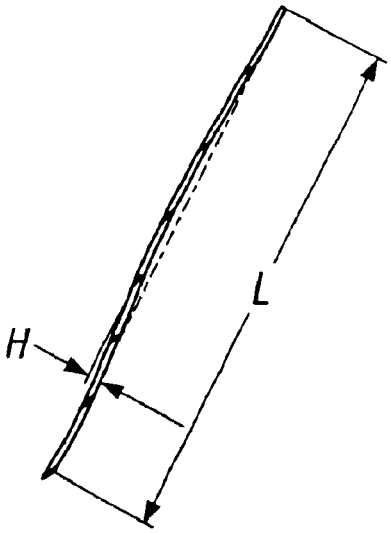
FIG. 36 is a cross-sectional view of the fan blade illustrated in FIGS. 27 and 28, taken along lines H—H of FIG. 28.

The blade 431 illustrated in FIGS. 27-36 has an extended trailing edge 483 as best shown in FIGS. 27 and 28. In addition, the outer edge 479 of the blade 431 has a substantially constant radius along a majority of (and in the illustrated embodiment of FIGS. 27-36, almost all of) the outer edge 479 of the blade 431 between points 485 and 487. However, the blade 431 in the illustrated embodiment of FIGS. 27-36 has a slightly smaller radial dimension near point 487 as shown in FIGS. 27 and 28, where it can be seen that a circle having a constant radius R extends past the edge of the blade 431 at point 487.

In some embodiments (such as the embodiment illustrated in FIGS. 27-36 described in greater detail below), the trailing edge 483 is defined in a manner dependent at least partially upon the shape of the trailing edge 483. With regard to this manner, some blades 431 employ a trailing edge 483 that has a substantially constant radius over at least a majority (and in many cases, a large majority or all) of the trailing edge 483. In some embodiments, the arc defined by this portion of the trailing edge 483 intersects or can be extended to intersect the imaginary circle having the constant radius R of the fan assembly 455. This point of intersection 487 can be on or off of the blade 31, and represents one manner of defining point 487 according to the present invention.

In other embodiments, point 487 is located at the intersection of the imaginary circle having the constant radius R substantially defined by the outer edge 479, and a line 501 extending from the rotational axis 463 swept counter-clockwise between about 62 and 78 degrees from line 495. In other cases, line 501 is swept counter-clockwise between about 65 and 75 degrees from line 495. In still other cases, line 501 is swept counter-clockwise between about 67 and 72 degrees from line 495.

In addition, point 491 in the embodiment of FIGS. 27-36 is defined as the location where the leading edge 481 of the blade 431 intersects an imaginary circle centered about the rotational axis 463 of the blade 431 and having a radius that is 0.75 times the length of the radius of the blade assembly (0.75R). Similarly, point 493 is defined as the location where the trailing edge 483 of the blade 431 intersects an imaginary circle centered about the rotational axis 463 of the blade 431 and having a radius that is 0.75 times the length of the radius of the blade assembly (0.75R).

As described above, the shape of the blade 431 according to the present invention can be defined by any one or more parameters. In this regard, any combination of such parameters can be employed to define a blade 431 according to the present invention. With continued reference to FIGS. 27-36, the angle $\alpha_{1'}$ (at which the leading edge 481 of the fan blade 431 is swept forward) falls between 15 and 35 degrees in some applications to produce good fan performance. In other applications, a leading edge angle $\alpha_{1'}$ falling between 18 and 30 degrees is employed for good fan performance. In still other applications, a leading edge angle $\alpha_{1'}$ falling between 20 and 28 degrees is employed for good fan performance.

With reference now to the trailing angle $\alpha_{1'}$ (at which the trailing edge 483 of the fan blade 431 is swept forward), the trailing angle $\alpha_{1'}$ falls between 5 and 20 degrees in some applications to produce good fan performance. In other applications, a trailing edge angle $\alpha_{t'}$ falling between 5 and 15 degrees is employed for good fan performance. In still other applications, a trailing edge angle $\alpha_{t'}$ falling between 8 and 12 degrees is employed for good fan performance.

As described above, the blade 431 can have a concave leading edge 481 having a chamber-to-chord ratio $H_{l'}/L_{l'}$. This chamber-to-chord ratio $H_{l'}/L_{l'}$ is between 0.05 and 0.30 in some applications to produce good fan performance. In other applications, a leading edge chamber-to-chord ratio $H_{l'}/L_{l'}$ falling between 0.10 and 0.25 is employed for good fan performance. In still other applications, a leading edge chamber-to-chord ratio $H_{l'}/L_{l'}$ falling between 0.15 and 0.20 is employed for good fan performance.

With reference now to the chamber-to-chord ratio $H_{t'}/L_{t'}$ of the trailing edge 483, the chamber-to-chord ratio $H_{t'}/L_{t'}$ of the trailing edge 483 falls between 0.05 and 0.20 in some applications to produce good fan performance. In other applications, a trailing edge chamber-to-chord ratio $H_t/L_t$ falling between 0.05 and 0.17 is employed for good fan performance. In still other applications, a trailing edge chamber-to-chord ratio $H_t/L_t$ falling between 0.07 and 0.12 is employed for good fan performance.

As also described above, the blade 431 can have a concave front side and can have a cross-sectional shape taken along line 403 that is flat or substantially flat along the outer radial portion of the blade 431. This flat or substantially flat portion of cross-section can be along the radially-outermost 25% of the blade 431 or along a larger radially-outermost portion of the blade 431 (such as the radially outermost half of the blade 431 in the embodiment of FIGS. 27-36) as desired, and can be at an angle β" with respect to a plane orthogonal to the rotational axis 463. This angle β" falls between 5 and 18 degrees in some applications to produce good fan performance. In other applications, this angle β" falls between 8 and 15 degrees for good fan performance. In still other applications, this angle β" falls between 10 and 15 degrees for good fan performance.

With reference again to FIGS. 27 and 28, cross-sections of the fan blade 431 can be taken at different radial distances from the rotational axis 463 of the fan assembly 455. In some embodiments of the present invention, the cross-sectional shapes of the blade 431 at such cross-sections changes with increasing distance from the rotational axis 463 of the fan assembly 455. In the illustrated embodiment of FIGS. 27-36 (and in still other embodiments of the present invention), these cross-sectional shapes are bowed, and define a camber-to-chord ratio H/L. In some embodiments, this camber-to-chord ratio H/L decreases with increasing distance from the rotational axis 463. For example, the camber-to-chord ratio H/L can decrease from 0.65R to the outer edge 479 of the blade 431 for good fan performance.

With reference now to FIGS. 27-32, the cross-sectional shape of the blade 431 at different radial locations of the blade 431 can be quantified in terms of camber to chord ratios H/L. In some applications, this camber-to-chord ratio H/L of the blade 431 at a radial distance of 0.95R falls between 4.0% and 9.5% for good fan performance. In other applications, this camber-to-chord ratio H/L falls between 5.5% and 8.5% for good fan performance. In still other applications, this camber-to-chord ratio H/L falls between 6.5% and 7.5% for good fan performance.

At a radial distance of 0.85R, the camber-to-chord ratio H/L of the blade 431 in some embodiments falls between 6.5% and 11.5% for good fan performance. In other applications, this camber-to-chord ratio H/L falls between 8.0% and 10.0% for good fan performance. In still other applications, this camber-to-chord ratio H/L falls between 8.5% and 9.5% for good fan performance.

At a radial distance of 0.75R, the camber-to-chord ratio H/L of the blade 431 in some embodiments falls between 8.5% and 13.5% for good fan performance. In other applications, this camber-to-chord ratio H/L falls between 9.0% and 12.0% for good fan performance. In still other applications, this camber-to-chord ratio H/L falls between 10.5% and 11.5% for good fan performance.

At a radial distance of 0.65R, the camber-to-chord ratio H/L of the blade 431 in some embodiments falls between 7.5% and 12.5% for good fan performance. In other applications, this camber-to-chord ratio H/L falls between 8.5% and 11.0% for good fan performance. In still other applications, this camber-to-chord ratio H/L falls between 9.5% and 10.5% for good fan performance.

As described in the embodiment of FIGS. 17-26 above, in some embodiments, additional strength and desirable air-flow characteristics are obtained by employing a blade tip section 435 that is not flat. Specifically, and with particular reference to FIGS. 28 and 34-36, the portion of the blade 431 that is adjacent to the tip 433 (such as the forwardmost 30% of the blade 431 with respect to the rotation of the blade 431) can be shaped to have a concave or convex cross-sectional shape, and in this regard can have a curved or angled cross-sectional shape formed in any manner desired. For example, the tip section 435 of the blade 431 can be stamped, embossed, machined, molded, pressed, or formed in any other manner to produce a curved or angled cross-sectional shape. The curved or angled cross-sectional shape can be constant or substantially constant across the tip section 435 of the blade 431 (i.e., in a direction away from the tip 433 and between the outer and leading edges 479, 481 of the blade 431), or can instead have a varying cross-sectional shape from the tip 433. In the illustrated preferred embodiment of FIGS. 27-36, the tip section 435 of the blade 431 has a concave cross-sectional shape on the front side of the blade 431 (also presenting a convex shape on the rear side of the blade 431).

As noted above, although the shapes of the fan blades 431 described above with reference to the embodiments of FIGS. 27-36 can be employed in blades having any size, superior results of these fan blade shapes have been obtained in fan assemblies having a diameter of between approximately 24 and 36 inches.

By virtue of the blade shape of the blade 31, 231, 431 according to the embodiments illustrated in FIGS. 1-36 above, the swept leading edge 81, 281, 481 can vary the timing of leading edge segments in order to cut through fixed-position turbulence generated during operation of the fan assembly 55, 255, 455 thereby changing the phase of the noise radiated by the fan blades 31, 231, 431. This leading edge shape and arrangement can therefore help to at least partially cancel acoustic energy as a result of phase differences (as compared to straight leading edges or other fan blade designs).

During operation of the fan blades according to some embodiments of the present invention (including those illustrated in FIGS. 1-36), boundary layers are formed along the suction face of the rotating fan blade 31, 231, 431 (i.e., the convex rear surface of the fan blades 31, 231, 431 in FIGS. 1-36) and become turbulent near the trailing edge 81, 281, 481 of the fan blade 31, 231, 431 due to a positive pressure gradient. This turbulence often significantly contributes to fan noise, and can be reduced by a well-swept trailing edge as employed in the fan blades 31, 231, 431 illustrated in FIGS. 1-36 and in other embodiments of the present invention. The natural path of air past the fan blades 31, 231, 431 (along which a boundary layer can be created) can be formed from the leading edge 81, 281, 481 to the trailing edge 83, 283, 483 and is moved slightly outward toward the tip of the fan blade 31, 231, 431 due to centrifugal effects. The shape of the trailing edge 83, 283, 483 of the fan blade 31, 231, 431 as described above can generate a relatively short air path, thereby reducing boundary layer separation, or turbulence, to reduce fan noise while maintaining a sufficient blade chord length to achieve air performance and efficiency. The curvature in the blade chord as described above with reference to some of the embodiments of the present invention (including those illustrated in FIGS. 1-36) can enable the blade to suck air from the blade tip to increase air flow, to reduce turbulence in the tip region, and to thereby reduce fan noise.

Although the blades 31, 231, 431 of the present invention can be any size as mentioned above and can have dimensions (e.g., angles and lengths) that fall within ranges or otherwise can vary, dimensions (in inches) for example blades are provided on FIGS. 4-11, 13, 15, 16, and 17.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A fan blade for rotation about an axis, the fan blade comprising:

a blade body;

a front side;

a back side;

an arcuate concave leading edge, the arcuate leading edge extending along a first arcuate line;

an outer edge extending along a second line, the outer edge at least partially defining a radius of the fan blade extending from the axis;

a first point at which the first and second lines intersect;

a second point on the concave leading edge at a location substantially equal to 0.75 times the radius of the fan blade; and an angle defined between a first line extending from the axis to the first point and a second line extending from the axis to the second point, the angle being between 15 and 35 degrees.

2. The fan blade as claimed in claim 1, wherein the angle is between 18 and 30 degrees.

3. The fan blade as claimed in claim 1, wherein the angle is between 20 and 28 degrees.

4. A fan blade for rotation about an axis, the fan blade comprising:

an arcuate concave leading edge, the arcuate concave leading edge extending along a first arcuate line;

an outer edge extending along a second line, the outer edge at least partially defining a radius of the fan blade extending from the axis;

a first point at which the first and second lines intersect; and a second point on the concave leading edge at a location substantially equal to 0.75 times the radius of the fan blade, the arcuate concave leading edge having a camber-to-chord ratio between the first and second points of between 0.05 and 0.30.

5. The fan blade as claimed in claim 4, wherein the chamber-to-chord ratio is between 0.10 and 0.25.

6. The fan blade as claimed in claim 4, wherein the camber-to-chord ratio is between 0.15 and 0.20.

7. A fan blade for rotation about an axis, the fan blade comprising:

an arcuate convex trailing edge, the arcuate convex trailing edge extending along a first arcuate line;

an outer edge extending along a second line, the outer edge at least partially defining a radius of the fan blade extending from the axis;

a first point at which the first and second lines intersect;

a second point on the convex trailing edge at a location substantially equal to 0.75 times the radius of the fan blade; and an angle defined between a first line extending from the axis to the first point and a second line extending from the axis to the second point, the angle being between 5 and 20 degrees.

8. The fan blade as claimed in claim 7, wherein the angle is between 5 and 15 degrees.

9. The fan blade as claimed in claim 7, wherein the angle is between 8 and 12 degrees.

10. A fan blade for rotation about an axis, the fan blade comprising:

an arcuate convex trailing edge, the arcuate concave trailing edge extending along a first arcuate line;

an outer edge extending along a second line, the outer edge at least partially defining a radius of the fan blade extending from the axis;

a first point at which the first and second lines intersect; and a second point on the convex trailing edge at a location substantially equal to 0.75 times the radius of the fan blade, the arcuate concave trailing edge having a camber-to-chord ratio between the first and second points of between 0.05 and 0.20.

11. The fan blade as claimed in claim 10, wherein the camber-to-chord ratio is between 0.05 and 0.17.

12. The fan blade as claimed in claim 10, wherein the camber-to-chord ratio is between 0.07 and 0.12.

13. A fan blade for rotation about an axis, the fan blade comprising:

a blade body;

a concave front surface;

a convex rear surface;

an arcuate concave leading edge;

an outer edge at least partially defining a radius of the fan blade extending from the axis;

a cross-sectional shape defined at a cross-section of the blade body taken at 0.65 times the radius of the fan blade, the cross-sectional shape having a camber-to-chord ratio of between 7.5% and 12.5%.

14. The fan blade as claimed in claim 13, where the camber-to-chord ratio is between 8.5% and 11.0%.

15. The fan blade as claimed in claim 13, wherein the camber-to-chord ratio is between 9.5% and 10.5%.

16. A fan blade for rotation about an axis, the fan blade comprising:

a blade body;

a concave front surface;

a convex rear surface;

an arcuate concave leading edge;

an outer edge at least partially defining a radius of the fan blade extending from the axis;

a cross-sectional shape defined at a cross-section of the blade body taken at 0.75 times the radius of the fan blade, the cross-sectional shape having a camber-to-chord ratio of between 8.5% and 13.5%.

17. The fan blade as claimed in claim 16, where the camber-to-chord ratio is between 9.0% and 12.0%.

18. The fan blade as claimed in claim 16, where the camber-to-chord ratio is between 10.5% and 11.5%.

19. A fan blade for rotation about an axis, the fan blade comprising:

a blade body;

a concave front surface;

a convex rear surface;

an arcuate concave leading edge;

an outer edge at least partially defining a radius of the fan blade extending from the axis;

a cross-sectional shape defined at a cross-section of the blade body taken at 0.85 times the radius of the fan blade, the cross-sectional shape having a camber-to-chord ratio of between 6.5% and 11.5%.

20. The fan blade as claimed in claim 19, where the camber-to-chord ratio is between 8.0% and 10.0%.

21. The fan blade as claimed in claim 19, where the camber-to-chord ratio is between 8.5% and 9.5%.

22. A fan blade for rotation about an axis, the fan blade comprising:

a blade body;

a concave front surface;

a convex rear surface;

an arcuate concave leading edge;

an outer edge at least partially defining a radius of the fan blade extending from the axis;

a cross-sectional shape defined at a cross-section of the blade body taken at 0.95 times the radius of the fan blade, the cross-sectional shape having a camber-to-chord ratio of between 4.0% and 9.5%.

23. The fan blade as claimed in claim 22, where the camber-to-chord ratio is between 5.5% and 8.5%.

24. The fan blade as claimed in claim 22, where the camber-to-chord ratio is between 6.5% and 7.5%.

* * * * *